US010800169B2

(12) United States Patent
Chikamoto

(10) Patent No.: US 10,800,169 B2
(45) Date of Patent: Oct. 13, 2020

(54) PRINT HEAD AND LIQUID DISCHARGING APPARATUS

(71) Applicant: SEIKO EPSON CORPORATION, Tokyo (JP)

(72) Inventor: Motonori Chikamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/697,232

(22) Filed: Nov. 27, 2019

(65) Prior Publication Data

US 2020/0171818 A1 Jun. 4, 2020

(30) Foreign Application Priority Data

Nov. 29, 2018 (JP) ..... 2018-223236

(51) Int. Cl.
*B41J 2/045* (2006.01)
*B41J 2/165* (2006.01)

(52) U.S. Cl.
CPC ..... *B41J 2/04541* (2013.01); *B41J 2/0451* (2013.01); *B41J 2/0452* (2013.01); *B41J 2/04543* (2013.01); *B41J 2/04581* (2013.01); *B41J 2/16579* (2013.01)

(58) Field of Classification Search
CPC .. B41J 2/04541; B41J 2/16579; B41J 2/0452; B41J 2/04543; B41J 2/0451
See application file for complete search history.

(56) References Cited

U.S. PATENT DOCUMENTS

2016/0059549 A1* 3/2016 Kamiyanagi ..... B41J 2/04581 347/10
2016/0279932 A1* 9/2016 Kamiyanagi ..... B41J 2/04581
2017/0246862 A1 8/2017 Abe

FOREIGN PATENT DOCUMENTS

JP 2017-149071 A 8/2017
JP 2017-149077 A 8/2017

* cited by examiner

*Primary Examiner* — Julian D Huffman
(74) *Attorney, Agent, or Firm* — Global IP Counselors, LLP

(57) ABSTRACT

Provided is a print head including: multiple discharging sections, each of which discharges liquid based on a drive signal; and a data management section that includes a first data retention section and manages first control data that controls a state of each of the multiple discharging sections, and inspection target discharging-section designation data that designates the discharging section which is to be inspected, which is among the multiple discharging sections; and a drive waveform selection section that selects a waveform of the drive signal for each of the multiple discharging sections, in which the data management section has a first transfer mode in which the first control data is parallelly transferred to the first data retention section, and a second transfer mode in which the first data retention section is caused to operate as a shift register that serially transfers the inspection target discharging-section designation data.

12 Claims, 19 Drawing Sheets

FIG. 13

| (SIH, SIL) | Sa | | Sb(Sc) | | SP |
|---|---|---|---|---|---|
| | T1 | T2 | T1 | T2 | |
| (1, 1) [LARGE-SIZED DOT] | H | H | L | L | SP1 TO SP4=1100 |
| (1, 0) [MIDDLE-SIZED DOT] | H | L | L | L | SP5 TO SP8=1000 |
| (0, 1) [SMALL-SIZED DOT] | L | H | L | L | SP9 TO SP12=0100 |
| (0, 0) [NON-RECORDING] | L | L | L | L | SP13 TO SP16=0000 |

FIG. 14

| (SIH, SIL) | Sa | | | Sb | | | Sc | | |
|---|---|---|---|---|---|---|---|---|---|
| | TS1 | TS2 | TS3 | TS1 | TS2 | TS3 | TS1 | TS2 | TS3 |
| (0, 0) [NON-INSPECTION] | L | L | L | L | L | L | L | L | L |
| (0, 1) [INSPECTION] | L | L | L | H | L | H | L | H | L |

FIG. 20

| | | | |
|---|---|---|---|
| Tp1 < Tth1 | – | – | RS = 2 [ABNORMALITY IN DISCHARGING (AIR BUBBLE)] |
| Tp1 ≥ Tth1 | Ap = 1 | Tp2 < Tth2 | RS = 2 [ABNORMALITY IN DISCHARGING (AIR BUBBLE)] |
| | | Tth2 ≤ Tp2 ≤ Tth3 | RS = 1 [NORMAL] |
| | | Tth3 < Tp2 ≤ Tth4 | RS = 3 [ABNORMALITY IN DISCHARGING (FOREIGN SUBSTANCE)] |
| | | Tth4 < Tp2 | RS = 4 [ABNORMALITY IN DISCHARGING (THICKENING)] |
| | Ap = 0 | – | RS = 5 [ABNORMALITY IN DISCHARGING] |

PRINT HEAD AND LIQUID DISCHARGING APPARATUS

The present application is based on, and claims priority from JP Application Serial Number 2018-223236, filed Nov. 29, 2018, the disclosure of which is hereby incorporated by reference herein in its entirety.

BACKGROUND

1. Technical Field

The present disclosure relates to a print head and a liquid discharging apparatus.

2. Related Art

It is known that, for example, a piezoelectric element is used for a liquid discharging apparatus, such as an ink jet printer, that discharges liquid, such as ink, and thus prints an image or a document. In this liquid discharging apparatus, the piezoelectric element is provided in a manner that corresponds to each of the multiple discharging sections in a print head, and is driven according to a drive signal. Thus, a prescribed amount of liquid is discharged from the discharging section at a prescribed timing and thus a dot is formed on a medium. For example, in a printing apparatus disclosed in JP-2017-149071, control data that controls supply of the drive signal to the piezoelectric element is transmitted in series to a drive IC provided in a head unit that discharges ink, and the control data is converted into parallel data by a shift register in the drive IC. Then, the supply of the drive signal to the piezoelectric element is controlled based on the parallel data, and thus ink is discharged and a dot is formed on a medium.

In this liquid discharging apparatus, due to thickening of liquid that fills the discharging section, mixing of an air bubble into the discharging section, or the like, in some cases, abnormality in discharging, which causes liquid not to be discharged from the discharging section, occurs. When the abnormality in discharging occurs, a dot that is intended to be formed on the medium is not precisely formed, and thus image quality decreases. In contrast with this, in JP-A-2017-149077, a printing apparatus is disclosed that detects vibration remaining in the discharging section after driving the discharging section and determines a discharged state of liquid in the discharging section based on a result of the detection.

In recent years, the number of nozzles that are one time caused to operate in order to increase a printing speed has been increased, and a size of printing data has also been increased with the increase in the number of nozzles. For that reason, in the printing apparatus disclosed in JP-A-2017-149071, the number of bits in a shift register into which control data is input increases in a drive IC. As a result, there is a problem in that current consumed for data transfer in the shift register increases. Furthermore, in the printing apparatus disclosed in JP-A-2017-149077, in order to inspect one discharging section, there occurs a need to transfer and process control data that is equivalent to an amount of transfer data in a normal printing operation. Because of this, when the number of nozzles increases, the data transfer and the data processing are bottlenecks, and there occurs a problem in that an inspection time is lengthened.

SUMMARY

The present disclosure can be realized in the following aspects or application examples.

According to an aspect of the present disclosure, there is provided a print head including: multiple discharging sections, each of which discharges liquid based on a drive signal; and a data management section that includes a first data retention section and manages first control data that controls a state of each of the multiple discharging sections, and inspection target discharging-section designation data that designates the discharging section to be inspected, which is among the multiple discharging sections; and a drive waveform selection section that selects a waveform of the drive signal for each of the multiple discharging sections, based on data that is retained by the first data retention section, in which the data management section has a first transfer mode in which the first control data is parallelly transferred to the first data retention section, and a second transfer mode in which the first data retention section is caused to operate as a shift register that serially transfers the inspection target discharging-section designation data.

In the print head, in the first transfer mode, the data management section may sequentially select each bit from the first data retention section and may transfer each bit data of the first control data to each selected bit, and thus may parallelly transfer the first control data to the first data retention section.

In the print head, a size of the inspection target discharging-section designation data may be smaller than a size of the first control data.

In the print head, the data management section may operate in the first transfer mode in a printing mode and may operate in the second transfer mode in an inspection mode.

In the print head, the first control data may be printing control data that controls discharging of liquid from each of the multiple discharging sections in the printing mode, or inspection control data that controls whether or not each of the multiple discharging sections is an inspection target, in the inspection mode, the inspection control data may have the inspection target discharging-section designation data, and the data management section may parallelly transfer the inspection control data to the first data retention section in the first transfer mode and then may transition from the first transfer mode to the second transfer mode.

In the print head, the data management section may include a second data retention section and may manage second control data that designates a rule in which the drive waveform selection section selects the waveform of the drive signal, may parallelly transfer the second control data to the second data retention section in the first transfer mode, and may retain the second control data in the second data retention section in the second transfer mode, and the drive waveform selection section may select the waveform of the drive signal based on the data that is retained by the first data retention section and data that is retained by the second data retention section.

According to another aspect of the present disclosure, there is provided a liquid discharging apparatus including: a print head: and a control section that controls the print head, in which the print head includes multiple discharging sections each of which discharges liquid based on a drive signal, a data management section that includes a first data retention section and manages first control data that controls a state of each of the multiple discharging sections, and inspection target discharging-section designation data that designates the discharging section to be inspected, which is among the multiple discharging sections, and a drive waveform selection section that selects a waveform of the drive signal for each of the multiple discharging sections, based on data that is retained by the first data retention section, the control section transmits the first control data to the data management section, and the data management section has a first transfer mode in which the first control data is parallelly transferred to the first data retention section, and a second transfer mode in which the first data retention section is caused to operate as a shift register that serially transfers the inspection target discharging-section designation data.

In the liquid discharging apparatus, in the first transfer mode, the data management section may sequentially select each bit from the first data retention section and may transfer each bit data of the first control data to each selected bits, and thus may parallelly transfer the first control data to the first data retention section.

In the liquid discharging apparatus, a size of the inspection target discharging-section designation data may be smaller than a size of the first control data.

In the liquid discharging apparatus, the data management section may operate in the first transfer mode in a printing mode and may operate in the second transfer mode in an inspection mode.

In the liquid discharging apparatus, the first control data may be printing control data that controls discharging of liquid from each of the multiple discharging sections in the printing mode, or inspection control data that controls whether or not each of the multiple discharging sections is an inspection target in the inspection mode, the inspection control data may have the inspection target discharging-section designation data, and data management section may parallelly transfer the inspection control data to the first data retention section in the first transfer mode and then may transition from the first transfer mode to the second transfer mode.

In the liquid discharging apparatus, the control section may transmit second control data that designates a rule in which the drive waveform selection section selects the waveform of the drive signal, to the data management section, the data management section may include a second data retention section, may manage the second control data, may parallelly transfer the second control data to the second data retention section in the first transfer mode, and may retain the second control data in the second data retention section in the second transfer mode, and the drive waveform selection section may select the waveform of the drive signal based on the data that is retained by the first data retention section and data that is retained by the second data retention section.

BRIEF DESCRIPTION OF THE DRAWINGS

FIG. 13 is a diagram illustrating a detail of decoding by a decoder in the printing mode.

FIG. 14 is a diagram illustrating a detail of the coding by the decoder in the inspection mode.

FIG. 20 is a diagram illustrating an example determination logic by a determination section.

DESCRIPTION OF EXEMPLARY EMBODIMENTS

Suitable embodiments of the present disclosure will be described in detail below with reference to the drawings. References to the drawings are for convenience of description. It is noted that the embodiments which will be described below do not improperly limit the subject matters of the present disclosure, which are claimed in claims. Furthermore, all configurations that will be described below are not necessarily essential requirements for the disclosure.

1. Overview of Liquid Discharging Apparatus

A printing apparatus, as an example of a liquid discharging apparatus according to the present embodiment, is an ink jet printer that discharges ink, which is liquid, according to image data supplied from an external host computer and thus forms an ink dot group on a printing medium such as a paper sheet, thereby printing images of character, an image, and the like in accordance with the image data.

Figure 1:
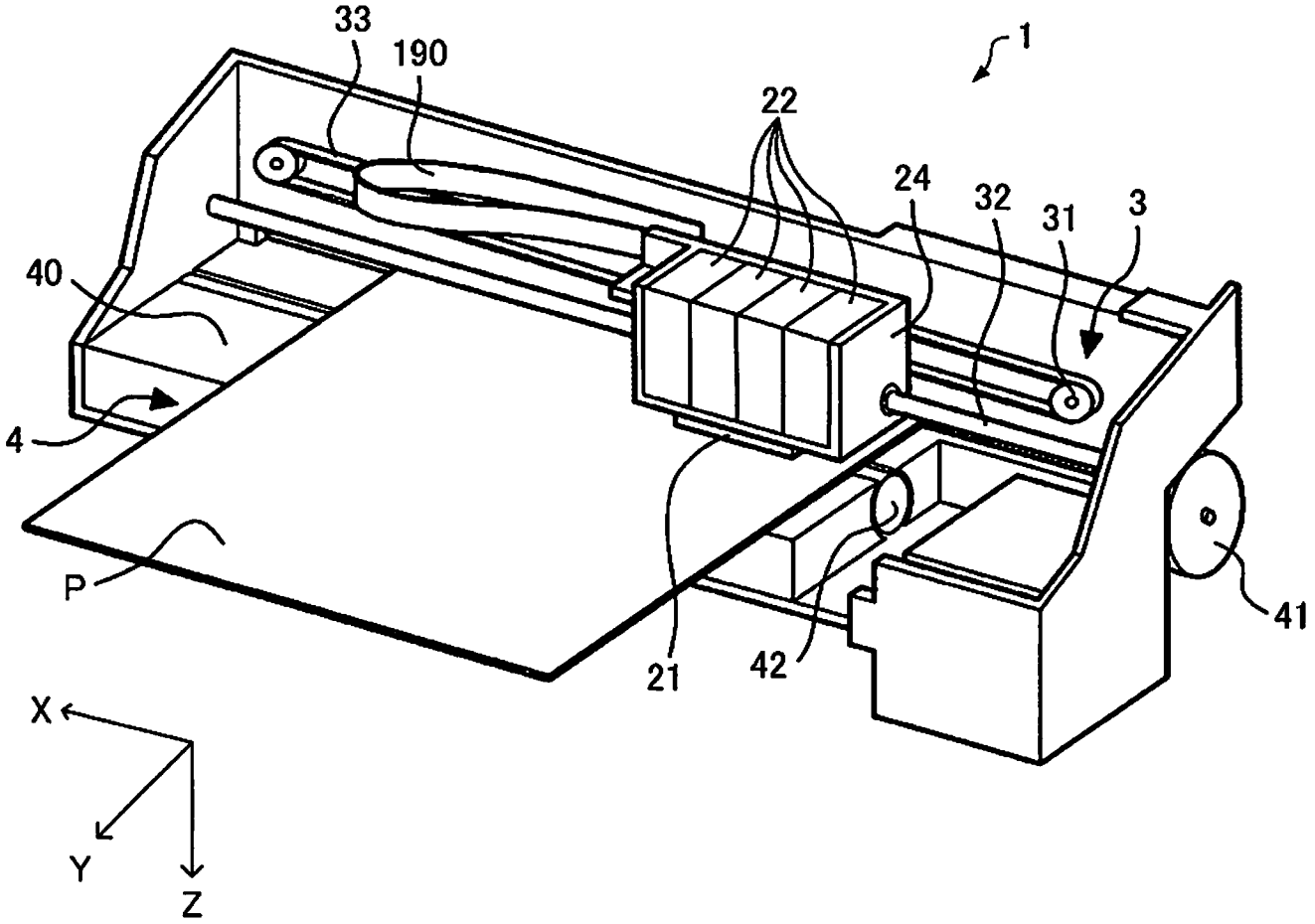
FIG. 1 is a diagram illustrating a schematic configuration of a liquid discharging apparatus.

FIG. 1 is a perspective diagram illustrating a schematic configuration of the inside of a liquid discharging apparatus 1 according to the present embodiment. As illustrated in FIG. 1, the liquid discharging apparatus 1 is a liquid discharging apparatus that is of serial scan type or is of a serial printing type, and includes a carriage 24 and a moving mechanism 3 that moves the carriage 24 in a main scanning direction X. Furthermore, although not illustrated, a USB port and a power source port are installed on the rear surface of the liquid discharging apparatus 1. That is, the liquid discharging apparatus 1 is configured in a manner that is connected to a computer or the like by way of the USB port. It is noted that, in the present embodiment, a moving direction of the carriage 24, a transportation direction of a printing medium P, and a vertical direction in the liquid discharging apparatus 1 are defined as the main scanning direction X, a sub-scanning direction Y, and Z, respectively, for the convenience of providing description. Furthermore, the main scanning direction X, the sub-scanning direction Y, and the vertical direction Z are illustrated, as three axes that orthogonally intersect each other, in the drawings, but a relationship in arrangement for each configuration is not necessarily limited to the orthogonal intersection.

The moving mechanism 3 includes a carriage motor 31 that is a drive source of the carriage 24, a carriage guidance shaft 32 on both ends of which is fixed, and timing belt 33 that extends nearly in parallel with the carriage guidance shaft 32 and is driven by the carriage motor 31.

The carriage 24 is not only supported on the carriage guidance shaft 32 in a reciprocating manner, but is also fixed to one portion of the timing belt 33. For that reason, when the carriage motor 31 causes the timing belt 33 to travel forward and backward, the carriage 24 is guided by the carriage guidance shaft 32 and thus reciprocates.

A print head 21 is mounted on the carriage 24 in such a manner as to face the printing medium P. The print head 21 is one for discharging ink droplets that is liquid droplets from multiple nozzles, and employs a configuration in which various control signals or the like are supplied by way of a cable 190. The cable 190, for example, may be a flexible flat cable (FFC).

Figure 2:
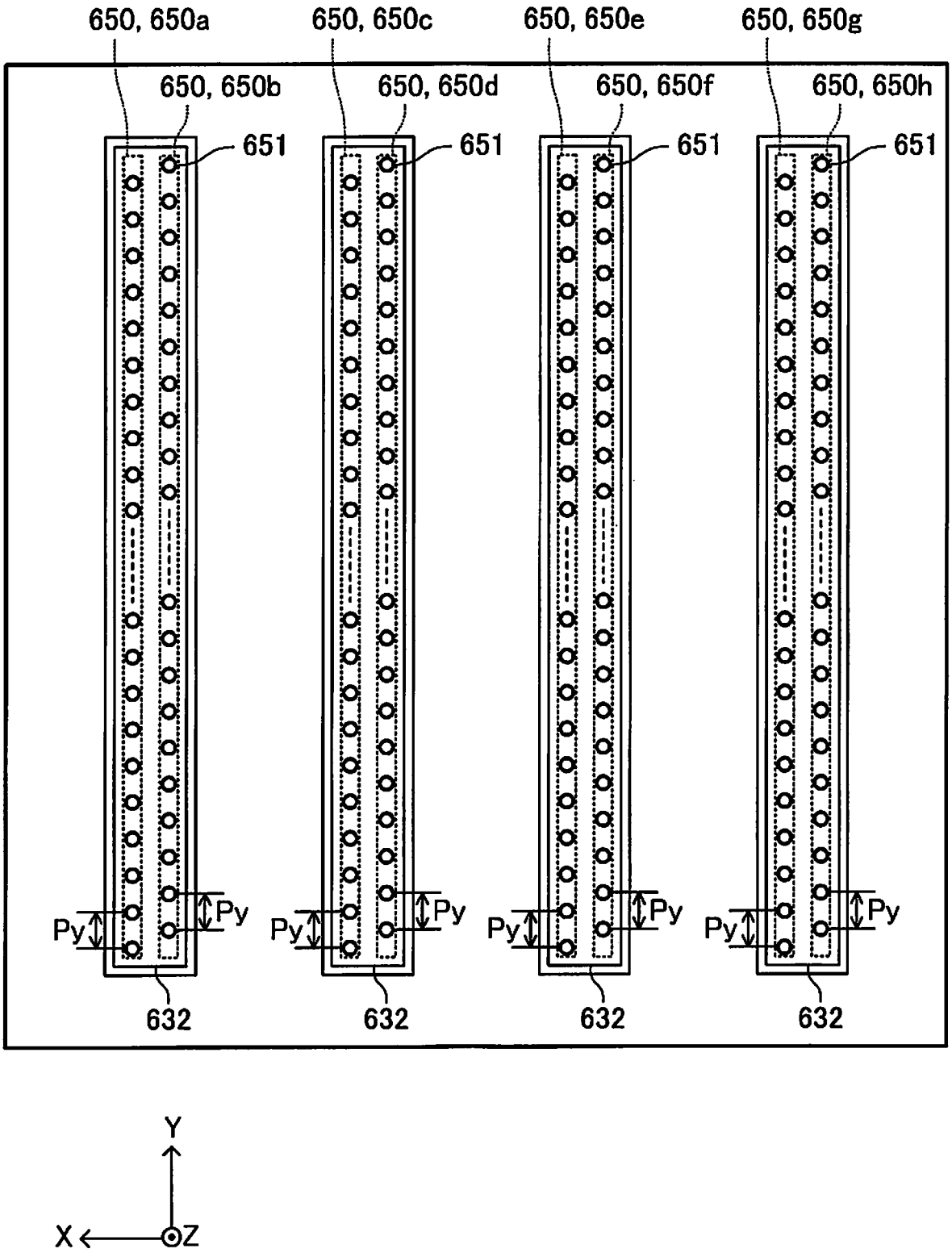
FIG. 2 is a diagram illustrating an ink discharging surface that is a lower surface of a print head.

FIG. 2 is a diagram illustrating an ink discharging surface that is a lower surface of the print head 21. As illustrated in FIG. 2, four nozzle plates 632, each of which includes two nozzle columns 650, each of which includes many nozzles 651 that are lined up one behind another at a given pitch Py along the sub-scanning direction Y, are provided to be lined up one behind another along the main scanning direction X on the ink discharging surface of the print head 21. Between two nozzle columns 650 that are provided in each nozzle plate 632, a relationship is established in which each nozzle 651 is shifted by half the pitch Py in the sub-scanning direction Y. In this manner, in the present embodiment, eight nozzle columns 650, specifically, a first nozzle column 650*a* to an eighth nozzle column 650*h*, are provided on the ink discharging surface of the print head 21.

Furthermore, as illustrated in FIG. 1, the liquid discharging apparatus 1 includes a transportation mechanism 4 that transport the printing medium P in the sub-scanning direction Y on a platen 40. The transportation mechanism 4 includes a transportation motor 41 and a transportation roller 42 that transports the printing medium P in the sub-scanning direction Y by being rotated by the transportation motor 41.

In the present embodiment, four ink cartridges 22 are stored in the carriage 24, and ink that fills each ink cartridge 22 is supplied to the print head 21. For example, inks for four colors, cyanogen, magenta, yellow, and black are four ink cartridge 22, respectively. It is noted that each ink cartridge 22 may be provided on an ink tank that is attached to the main body side without being mounted on the carriage 24, and the ink that fills each ink cartridge 22 may be supplied all the way up to the print head 21 by way of an ink tube.

At a timing when the printing medium P is transported by the transportation mechanism 4, the print head 21 discharges the ink droplet in the vertical direction Z toward the printing medium P, that is, downward in the vertical direction, and thus an image is formed on a surface of the printing medium P.

2. Electrical Configuration of Liquid Discharging Apparatus

Figure 3:
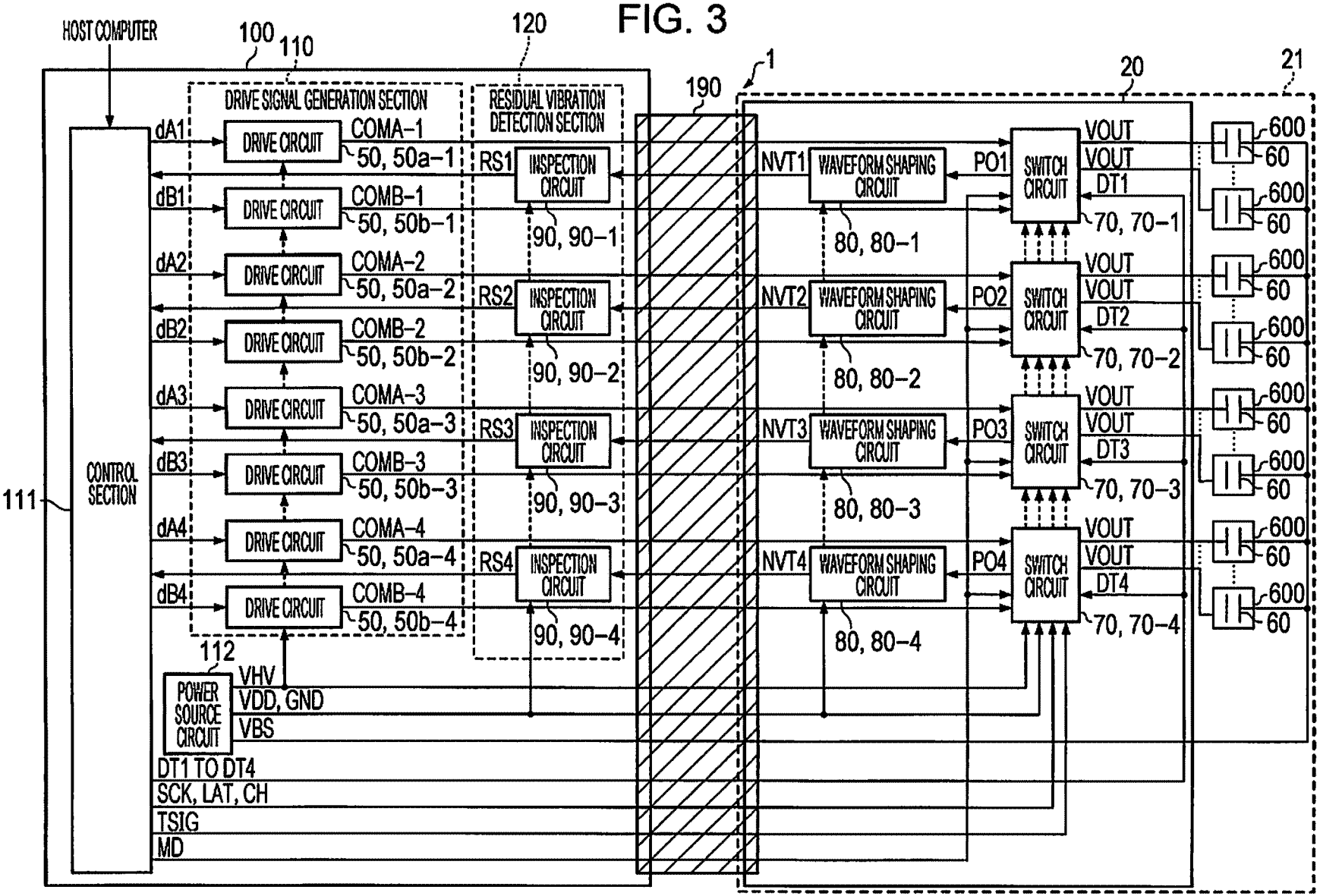
FIG. 3 is a block diagram illustrating an electrical configuration of the liquid discharging apparatus.

FIG. 3 is a block diagram illustrating an electrical configuration of the liquid discharging apparatus 1 according to the present embodiment. As illustrated in FIG. 3, the liquid discharging apparatus 1 includes a control substrate 100 and the print head 21. The print head 21 includes a head substrate 20, and multiple discharging sections 600.

The control substrate 100 is fixed to a given place within the liquid discharging apparatus 1 and is connected by the cable 190 to the head substrate 20.

Provided on the control substrate 100 are a control section 111, a power source circuit 112, eight drive circuits 50, that is, drive circuits 50*a*-1 to 50*a*-4 and 50*b*-1 to 50*b*-4, and 4-four inspection circuits 90, that is, inspection circuits 90-1 to 90-4.

The control section 111 controls the print head 21. The control section 111, for example, is expressed as a processor such as a microcontroller, and, based on various signals, such as image data, that are supplied from a host computer, generates various pieces of data or various signals.

Specifically, based on the various signals from the host computer, the control section 111 generates pieces drive data dA1 to dA4 and dB1 to dB4 that are pieces of digital pieces which are sources of drive signals COMA-1 to COMA-4 and COMB-1 to COMB-4 that drive the discharging sections 600, respectively. The pieces of drive data dA1 to dA4 are supplied to drive circuits 50*a*-1 to 50*a*-4, respectively, and the pieces of drive data dB1 to dB4 are supplied to the drive circuit 50*b*-1 to 50*b*-4, respectively. The pieces of drive data dA1 to dA4 are pieces of digital data that prescribe waveforms of the drive signals COMA-1 to COMA-4, respectively, and the pieces of drive data dB1 to dB4 are pieces of digital data that prescribe waveforms of drive signal COMB-1 to COMB-4, respectively.

Furthermore, based on the various signals from the host computer, the control section 111 generates four data signals, data signals DT1 to DT4, a latch signal LAT, a change signal CH, and a clock signal SCK, as multiple types of control signals that control discharging of liquid from each discharging section 600. Furthermore, the control section 111 generates an operation mode instruction signal MD that provides an instruction on each of the operation modes of switch circuits 70-1 to 70-4. The operation mode instruction signal MD, for example, may be a command that instructs each of the switch circuits 70-1 to 70-4 to proceed to a printing mode or an inspection mode.

Furthermore, the control section 111 includes an inspection control signal TSIG that provides an instruction on starting and ending of detection of residual vibration that is vibration which stays behind in the discharging section 600 after driving the discharging section 600. The data signals DT1 to DT4, the latch signal LAT, the change signal CH, the clock signal SCK, the operation mode instruction signal MD, and the inspection control signal TSIG are transferred from the control section 111 to the print head 21 over the cable 190.

It is noted that in addition to the above-described processing, the control section 111 also performs processing that recognized a scanning position of the carriage 24 and that drives the carriage motor 31 based on the scanning position of the carriage 24. Accordingly, a movement of the carriage 24 toward the main scanning direction X is controlled. Furthermore, the control section 111 performs processing that drives the transportation motor 41. Accordingly, a movement of the printing medium P toward the sub-scanning direction Y is controlled.

Moreover, the control section 111 causes a maintenance mechanism, which is not illustrated, to perform maintenance processing for restoring a state where the print head 21 discharges ink to a normal state, for example, a clearing processing or a wiping state.

The power source circuit 112, for example, generates a constant high power source voltage VHV that, for example is 42 V, a low power source voltage VDD, a constant offset voltage VBS, and a ground voltage GND. The high power source voltage VHV, the low power source voltage VDD, the offset voltage VBS, and the ground voltage GND are transferred from the power source circuit 112 to the print head 21 over the cable 190. For example, the high power source voltage VHV is 42 V, the low power source voltage VDD is 3.3 V, the offset voltage VBS is 6 V, and the ground voltage GND is 0 V. Furthermore, the high power source voltage VHV, the low power source voltage VDD, and the ground voltage GND each are supplied to the drive circuits 50*a*-1 to 50*a*-4 and 50*b*-1 to 50*b*-4.

Based on the pieces of drive data dA1 to dA4 and the dB1 to dB4, the drive circuits 50*a*-1 to 50*a*-4 and 50*b*-1 to 50*b*-4 generates the drive signals COMA-1 to COMA-4 and the COMB-1 to COMB-4, respectively, that drives a piezoelectric element 60 which is included in the discharging section 600. For example, the drive circuits 50*a*-1 to 50*a*-4 and 50*b*-1 to 50*b*-4 performs digital/analog conversion of, and then D-grade amplification of, the pieces of drive data dA1 to dA4 and the dB1 to dB4, respectively, and thus generates the drive signals COMA-1 to COMA-4 to the COMB-1 to COMB-4, respectively. The pieces of drive data dA1 to dA4 and dB1 to dB4 are pieces of data that prescribe forms of the drive signals COMA-1 to COMA-4 and COMB-1 to COMB-4, respectively. It is noted that the drive circuits 50*a*-1 to 50*a*-4 and 50*b*-1 to 50*b*-4 are different only in terms of pieces of data that are input and drive signals that are output, and may employ the same circuit configurations.

It is noted that in the present embodiment, the drive circuits 50*a*-1 to 50*a*-4 and 50*b*-1 to 50*b*-4 makes up a drive signal generation section 110 that generates the drive signals COMA-1 to COMA-4 and COMB-1 to COMB-4 which drive the piezoelectric element 60.

The drive signals COMA-1 to COMA-4 and the COMB-1 to COMB-4 are transferred from the control substrate 100 to the head substrate 20 over the cable 190.

Provided on the head substrate 20 are four switch circuits 70, that is, the switch circuits 70-1 to 70-4, and four waveform shaping circuits 80, that is, waveform shaping circuits 80-1 to 80-4.

Input into the switch circuits 70-1 to 70-4 are the drive signals COMA-1 to COMA-4, the drive signal COMB-1 to COMB-4, and the data signals DT1 to DT4, respectively. Furthermore, the clock signal SCK, the latch signal LAT, the change signal CH, and the inspection control signal TSIG are input in common into the switch circuits 70-1 to 70-4. The switch circuits 70-1 to 70-4 operate by being provided with the high power source voltage VHV, the low power source voltage VDD, and the ground voltage GND and output a drive signal VOUT to each of the multiple discharging sections 600 that are included in the print head 21. Specifically, based on the clock signal SCK, the data signal DT1, the latch signal LAT, the change signal CH, and the inspection control signal TSIG, the switch circuit 70-1 selects any one of the drive signal COMA-1 and the drive signal COMB-1 and outputs the selected drive signal as the drive signal VOUT, or does not select any one of the drive signal and sets an output to be at high impedance. In the same manner, based on the clock signal SCK, the data signal DT1, the latch signal LAT, the change signal CH, and the inspection control signal TSIG, the switch circuit 70-2 selects any one of the drive signal COMA-2 and the drive signal COMB-2 and outputs the selected drive signal as the drive signal VOUT, or does not select any drive signal and sets an output to be at high impedance. In the same manner, based on the clock signal SCK, the signal DT1, the latch signal LAT, the change signal CH, and the inspection control signal TSIG, the switch circuit 70-3 selects any one of the drive signal COMA-3 and the drive signal COMB-3 and outputs the selected drive signal as the drive signal VOUT, or does not select any drive signal and sets an output to be at high impedance. In the same manner, based on the clock signal SCK, the digital signal DT1, the latch signal LAT, the change signal CH, and the inspection control signal TSIG, the switch circuit 70-4 selects any one of the drive signal COMA-4 and the drive signal COMB-4 and outputs the selected drive signal as the drive signal VOUT, or does not select any drive signal and sets an output to be at high impedance.

The drive signal VOUT that is output by the switch circuit 70-1 is applied to one end of the piezoelectric element 60 that is included in each discharging section 600 which is provided in a manner that corresponds to the first nozzle column 650*a* and the second nozzle column 650*b*. Furthermore, the drive signal VOUT that is output by the switch circuit 70-2 is applied to one end of the piezoelectric element 60 that is included in each discharging section 600 which is provided in a manner that corresponds to the third nozzle column 650*c* and the fourth nozzle column 650*d*. Furthermore, the drive signal VOUT that is output by the switch circuit 70-3 is applied to one of the piezoelectric element 60 that is included in each discharging section 600 which is provided in a manner that corresponds to the fifth nozzle column 650*e* and the sixth nozzle column 650*f*. Furthermore, the drive signal VOUT that is output by the switch circuit 70-4 is applied to one end of the piezoelectric element 60 that is included in each discharging section 600 which is provided in a manner that corresponds to the seventh nozzle column 650*g* and the eighth nozzle column 650*h*. The offset voltage VBS is applied in common to the other end of each of the piezoelectric element 60. Then, the piezoelectric element 60 is displayed according to a difference in electric potential between the drive signal VOUT and the offset voltage VBS and discharges an amount of ink in accordance with the displacement from the nozzle 651. Alternatively, the piezoelectric element 60 is displaced according to a difference in electric potential between the drive signal VOUT and the offset voltage VBS, and the residual vibration occurs in the discharging section 600 without discharging ink from the nozzle 651. However, ink may be discharged through the nozzle 651, and the residual vibration may occur in the discharging section 600.

The switch circuits 70-1 to 70-4 each includes a printing mode and an inspection mode as operation modes. In the printing mode, the switch circuits 70-1 to 70-4 each discharge liquid from the print head 21 on to the printing medium P and output the drive signal VOUT for forming an image.

In the inspection mode, based on the data signal DT1 and the inspection control signal TSIG, the switch circuit 70-1 switches between whether or not to make an electric connection between one end of the piezoelectric element 60, which is included in each discharging section 600 which is provided in a manner that corresponds to the first nozzle column 650*a* or the second nozzle column 650*b*, and the inspection circuit 90-1. In the same manner, in the inspection mode, based on the digital signal DT2 and the inspection control signal TSIG, the switch circuit 70-2 switches between whether or not to make an electric connection between one end of the piezoelectric element 60, which is included in each discharging section 600 which is provided in a manner that corresponds to the third nozzle column 650*c* or the fourth nozzle column 650*d*, and the inspection circuit 90-2. In the same manner, in the inspection mode, based on the digital signal DT3 and the inspection control signal TSIG, the switch circuit 70-3 switches between making an electric connection between one end of the piezoelectric element 60, which is included in each discharging section 600 which is provided in a manner that corresponds to the fifth nozzle column 650*e* or the sixth nozzle column 650*f*, and the inspection circuit 90-3. In the same manner, in the inspection mode, based on the data signal DT4 and the inspection control signal TSIG, the switch circuit 70-4 switches between whether or not to make an electric connection between one end of the piezoelectric element 60, which is included in each discharging section 600 which is provided in a manner that corresponds to the seventh nozzle column 650*g* or the eighth nozzle column 650*h*, and the inspection circuit 90-4.

Specifically, in the inspection mode, based on the data signals DT1 to DT4, the switch circuits 70-1 to 70-4, respectively, select the discharging section 600 that is an inspection target in a discharge state. Furthermore, based on the inspection control signal TSIG, the switch circuits 70-1 to 70-4 electrically connect one end of the piezoelectric element 60, which is included in the selected discharging section 600, that is, the discharging section 600 that is the inspection target, to the waveform shaping circuits 80-1 to 80-4, respectively, and electrically disconnect one end of a different piezoelectric element 60 that is not selected, that is, the piezoelectric element 60 that is included in the discharging section 600 which is not an inspection target, from the waveform shaping circuits 80-1 to 80-4, respectively. Then, with the switch circuits 70-1 to 70-4, in a state where one end of each of the piezoelectric elements 60 that are included in four discharging sections 600, respectively, which are inspection targets, and each of the waveform shaping circuits 80-1 and 80-4, are electrically connected, inspection target signals PO1 to PO4, each of which appears in one end of each of the piezoelectric elements 60 which are included in the four discharging sections 600, respectively, that are inspection targets, are input into the waveform shaping circuits 80-1 to 80-4, respectively.

It is noted that the switch circuits 70-1 to 70-4 may employ the same circuit configuration, and that the circuit configuration will be described in detail below.

The inspection target signals PO1 to PO4 are input into the waveform shaping circuit 80-1 to 80-4, respectively and the waveform shaping circuit 80-1 to 80-4 each operate by being provided with the low power source voltage VDD and the ground voltage GND. The waveform shaping circuits 80-1 and 80-4 not only remove noise components, respectively, from the inspection target signals PO1 to PO4, using a low pass filter or a band pass filter, but also output residual vibration signals NVT1 to NVT4, respectively, that result from amplifying amplitudes of the inspection target signals PO using an arithmetic operation amplifier, a resistor, and the like. The residual vibration signals NVT1 to NVT4 are transferred from the head substrate 20 to the control substrate 100 over the cable 190. It is noted that the waveform shaping circuits 80-1 to 80-4 may employ the same circuit configuration.

The switch circuit 70-1 and the waveform shaping circuit 80-1 may be configured as integrated circuits on one chip. In the same manner, the switch circuit 70-2 and the waveform shaping circuit 80-2 may be configured as integrated circuits on one chip. In the same manner, the switch circuit 70-3 and the waveform shaping circuit 80-3 may be configured as integrated circuits on one chip. In the same manner, the switch circuit 70-4 and the waveform shaping circuit 80-4 may be configured as an integrated circuit on one chip. If this is done, wiring lines over which the inspection target signals PO1 to PO4 that are low-amplitude analog signals propagate are short, and degradations of the inspection target signals PO1 to PO4 due to noise are reduced.

The residual vibration signals NVT1 to NVT4, along with the inspection control signal TSIG, are input into the inspection circuits 90-1 to 90-4, respectively, and the inspection circuits 90-1 to 90-4 each operate by being provided with the low power source voltage VDD and the ground voltage GND. The inspection circuits 90-1 and 90-4 are synchronized to the inspection control signal TSIG, and based on the residual vibration signals NVT1 to NVT4, respectively, detect the residual vibration of the discharging section 600 after the drive signal VOUT is applied to the piezoelectric element 60 that is included in the discharging section 600 which is an inspection target. Moreover, based on a result of the detection of the residual vibration, the inspection circuits 90-1 to 90-4 determines a state where ink is discharged in the discharging section 600 that is an inspection target and output determination result signals RS1 to RS4, respectively, each of which indicates a result of the determination. It is noted that the inspection circuits 90-1 and 90-4 may employ the same circuit configuration and that the circuit configuration will be described in detail below.

The control section 111 performs processing in accordance with the determination result signals RS1 to RS4. For example, when at least one of the determination result signals RS1 to RS4 indicates that abnormality in discharging occurs in the discharging section 600, the control section 111 may display an error message on a display, which is not illustrated, that is included in the liquid discharging apparatus 1. Furthermore, for example, the control section 111 may generate a control signal for causing the maintenance mechanism, which is not illustrated, to perform the maintenance processing, and may generate the data signals DT1 to DT4 for performing correction recording processing that corrects recording on the printing medium P by the discharging section 600 that is not abnormal in discharging, instead of the discharging section 600 that is abnormal in discharging.

It is noted that the inspection circuits 90-1 to 90-4 make up a residual vibration detection section 120 which detects the residual vibration of the discharging section 600.

3. Configuration of Discharging Section

Figure 4:
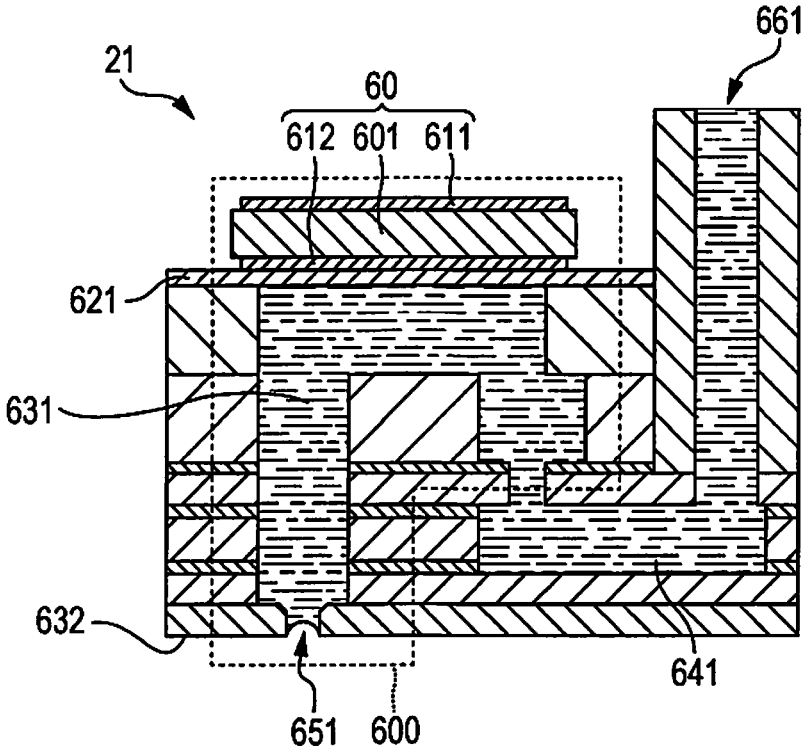
FIG. 4 is a diagram illustrating a schematic configuration that corresponds to one discharging section.

FIG. 4 is a diagram illustrating a schematic configuration that corresponds to one discharging section 600 that is included in the print head 21. As illustrated in FIG. 4, the print head 21 includes the discharging section 600 and a reservoir 641.

The reservoir 641 is provided for every color of ink, and ink is introduced from a supply outlet 661 into the reservoir 641. It is noted that ink is supplied from the ink cartridge 22 all the way up to the supply outlet 661.

The discharging section 600 includes the piezoelectric element 60, a vibration plate 621, a cavity 631 that is a chamber, and the nozzle 651. Among these, the vibration plate 621 is displaced by the piezoelectric element 60 that is provided on an upper surface thereof in FIG. 4, and functions as a diaphragm that increases or decreases an internal volume of the cavity 631 that is filled with ink. The nozzle 651 is an opening portion that is provided in the nozzle plate 632 and communicates with the cavity 631. The cavity 631 is filled with ink, and an internal volume thereof changes with the displacement of the piezoelectric element 60. The nozzle 651 communicates with the cavity 631, and through the nozzle 651, ink within the cavity 631 is discharged in the form of a liquid droplet according to a change in the internal volume of the cavity 631. In this manner, the discharging section 600 discharges ink from the nozzle 651 by the piezoelectric element 60 being driven.

The piezoelectric element 60, which is illustrated in FIG. 4, employs a structure in which a piezoelectric body 601 is interposed between a pair of electrodes 611 and 612. The center portion of the piezoelectric body 601 in this structure in FIG. 4 warps in the upward-downward direction with respect to both terminal portions thereof, along with the electrodes 611 and 612 and the vibration plate 621, according to voltages that are applied by the electrodes 611 and 612. Specifically, the drive signal VOUT is applied to the electrode 611 that is one terminal of the piezoelectric element 60, and the offset voltage VBS is applied to the electrode 612 that is the other terminal of the piezoelectric element 60. Then, the piezoelectric element 60 employs a configuration in which, when a voltage of the drive signal VOUT decreases, the piezoelectric element 60 warps in the upward direction, and in which, on the other hand, when the voltage of the drive signal VOUT increases, the piezoelectric element 60 warps in the downward direction. With this configuration, if the warping occurs in the upward direction, because the internal volume of the cavity 631 increases, ink flows from the reservoir 641 into the cavity 631, and on the other hand, if the warping occurs in the downward direction, because the interval volume of the cavity 631 decreases, ink is discharged through the nozzle 651 according to the degree to which the internal volume decreases.

It is noted that the piezoelectric element 60 is not limited to the structure that is illustrated, and that any type of structure in which transformation of the piezoelectric element 60 causes liquid, such as ink, to be discharged may be employed. Furthermore, the piezoelectric element 60 is not limited to this bending vibration, and a configuration in which so-called longitudinal vibration is used may be employed.

Furthermore, the piezoelectric element 60 is provided in a manner that corresponds to the cavity 631 and the nozzle 651 in the print head 21, and is provided in a manner that also corresponds to a selection circuit 230 that will be described below. For this reason, a set of the piezoelectric element 60, the cavity 631, the nozzle 651, and the selection circuit 230 is provided for every nozzle 651.

4. Configuration of Drive Signal

In the present embodiment, with a liquid droplet that is discharged through each nozzle 651 which is included in the first nozzle column 650*a* or the second nozzle column 650*b*, four gradations, a "large-sized dot," a "middle-sized dot," a "small-sized dot, and "non-recording" are expressed for one dot. Because of this, the drive signal COMA-1 is prepared and one periodicity of the drive signal COMA-1 is caused to take the first half pattern and the second half pattern. A configuration is employed in which, according to the gradation that has to be expressed, the drive signal COMA-1 in the first half and second half of one periodicity is selected and the selected drive signal COMA-1 is supplied to the piezoelectric element 60 that is provided in a manner that corresponds to each nozzle 651, or in which the drive signal COMA-1 is not supplied to the piezoelectric element 60. Moreover, in the present embodiment, in order to make an inspection of a discharging section 600 that is an inspection target, which is among the discharging sections 600 that are provided in a manner that corresponds to the first nozzle column 650*a* or the second nozzle column 650*b*, the drive signal COMB-1 is also prepared separately from the drive COMA-1. Furthermore, in the present embodiment, the drive signals COMA-2 to COMA-4, which have the same purpose as the drive signal COMA-1, are prepared, the drive signals COMB-2 to Comb-4, which have the same purpose as the drive signal COMB-1, are prepared.

It is noted that the drive signals COMA-1 to COMA-4 take somewhat different waveforms due to different types of ink that is discharged, but employ the same basic configuration, and that, because of this, the drive signals COMA-1 to COMA-4 are hereinafter collectively referred to a drive signal COMA and the drive signal COMA will be described below with reference to a diagrammatic representation. In the same manner, the drive signals COMB-1 to COMB-4, although somewhat different in waveforms, employ the same basic configuration, and that, because of this, the drive signals COMB-1 to COMB-4 are hereinafter collectively referred to a drive signal COMB and the drive signal COMB will be described below with reference to a diagrammatic representation.

Figure 5:
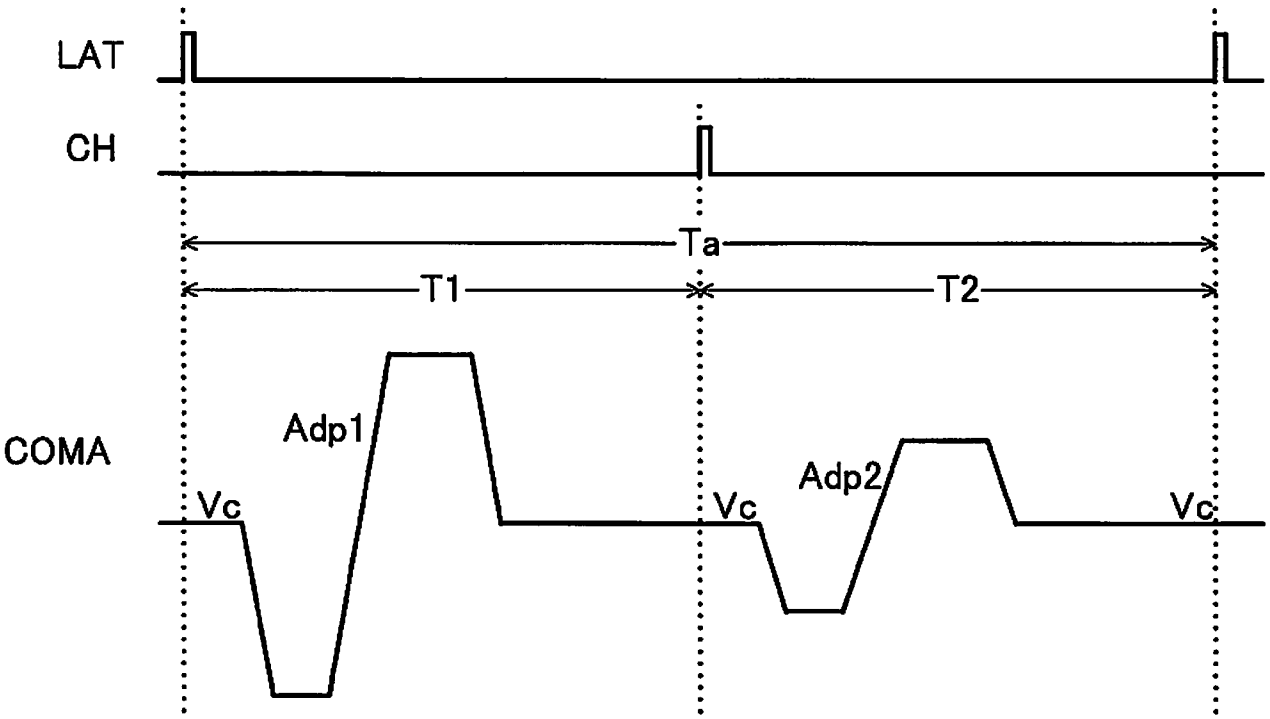
FIG. 5 is a diagram illustrating a waveform of a drive signal.

FIG. 5 is a diagram illustrating a waveform of the drive signal COMA. As illustrated in FIG. 5, the drive signal COMA takes a waveform that results from successively combining a trapezoid waveform Adp1 that is disposed during a duration T1 from when a pulse of the latch signal LAT is in the rising phase to when a pulse of the change signal CH is in the rising phase, and a trapezoid waveform Adp2 that is disposed during a duration T2 from when the pulse of the change signal CH is in the rising phase to when a next pulse of the latch signal LAT is in the rising phase. A periodicity that is made up of the duration T1 and the duration T2 is defined as a periodicity Ta. A new dot is formed on the printing medium P at every periodicity Ta.

In the first embodiment, the trapezoid waveforms Adp1 and Adp2 are different waveforms. Among these, the trapezoid waveform Adp1 is a waveform that, if set to be supplied to one terminal of the piezoelectric element 60, causes a given amount of ink, specifically, a middle-sized amount of ink, to be discharged through the nozzle 651 that corresponds to the piezoelectric element 60. Furthermore, the trapezoid waveform Adp2 is a waveform that, if set to be supplied to one terminal of the piezoelectric element 60, causes an amount of ink, which is smaller than the given amount of ink, specifically, a small-sized amount of ink, to be discharged through the nozzle 651 that corresponds to the piezoelectric element 60.

Any one of a voltage at a starting timing and a voltage at an ending timing for the trapezoid waveforms Adp1 and Adp2 is a voltage Vc shared in common. That is, each of the trapezoid waveforms Adp1 and Adp2 is a waveform that starts at the voltage Vc and ends at the voltage Vc.

Figure 6:
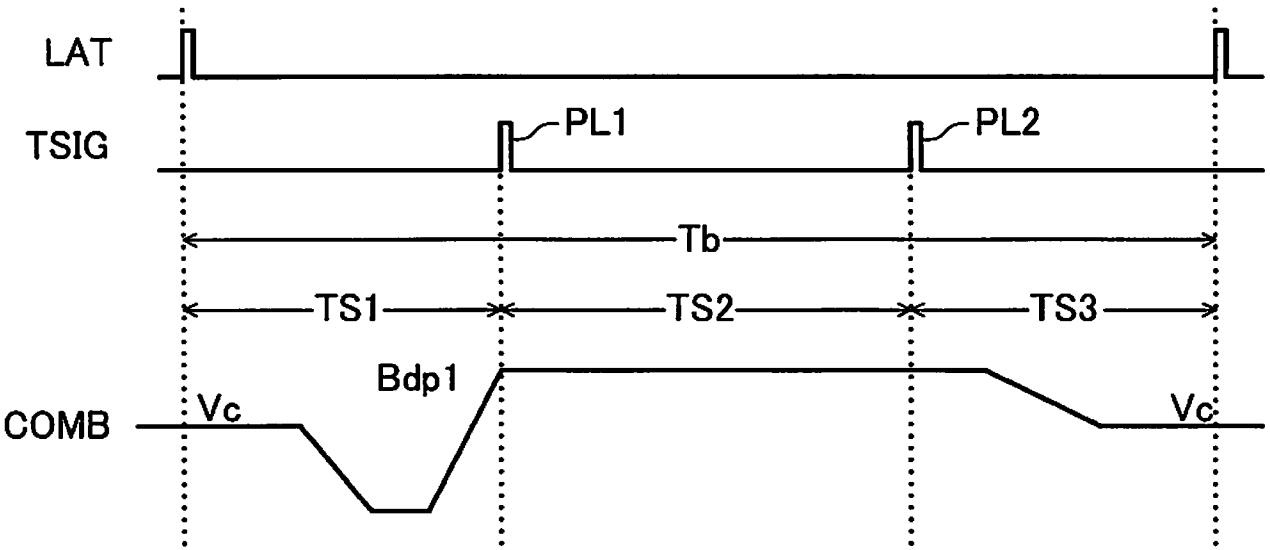
FIG. 6 is a diagram illustrating a waveform of a drive signal.

FIG. 6 is a diagram illustrating a waveform of the drive signal COMB. As illustrated in FIG. 6, the drive signal combine takes a trapezoid waveform Bdp1 that is disposed over the entire periodicity Tb that is a duration made up of a duration TS1, a duration TS2, and a duration TS3 is disposed over periodicity Tb. At this point, the durations TS1, TS2, and TS3 are prescribed by the inspection control signal TSIG. Specifically, the inspection control signal TSIG is a signal that indicates the starting of the detection of the residual vibration of each of the discharging sections 600 by each of the inspection circuits 90-1 to 90-4, and takes a first pulse PL1 that prescribes a timing for the starting of the detection of the residual vibration during the periodicity Tb. Furthermore, the inspection control signal TSIG is also a signal that indicates the ending of the detection of the residual vibration of each discharging section 600 by each of the inspection circuits 90-1 to 90-4, and takes a second pulse PL2 that prescribes the timing for the ending of the detection of the residual vibration during the periodicity Tb. The duration TS1 is a duration from when the pulse of the latch signal LAT is in the rising phase to when the first pulse PL1 is in the rising phase. The duration TS2 is a duration from when the first pulse PL1 is in the rising phase to when the second pulse PL2 is in the rising phase. The duration TS3 is a duration from when the second pulse PL2 of the inspection control signal TSIG is in the rising phase to when a next pulse of the latch signal LAT is in the rising phase.

The trapezoid waveform Bdp1 is a waveform for driving the piezoelectric element 60 in order not to discharge an ink droplet through nozzle 651, if the trapezoid waveform Bdp1 is set to be supplied to one end of the piezoelectric element 60. Any one of the voltage at the starting timing and the voltage at the ending timing of the trapezoid waveform Bdp1 is the voltage Vc shared in common. That is, the trapezoid waveform Bdp1 is a waveform that starts at the voltage Vc and ends at the voltage Vc.

It is noted that the drive signals COMA and COMB that are illustrated in FIGS. 5 and 6 are only examples. In practice, a combination of various waveforms that are prepared in advance is used according to a moving speed of the carriage 24, the printing medium P, a structure of the discharging section 600, the viscosity of ink, and the like. Furthermore, the example where the piezoelectric element 60 warps in the upward direction due to a decrease in voltage is described here, but when voltages that are supplied to the electrodes 611 and 612 are reversed, the piezoelectric element 60 warps in the downward direction due to the decrease in voltage. For this reason, in the configuration in which the piezoelectric element 60 warps in the downward direction due to the decrease in voltage, the drive signals COMA and COMB that are illustrated in FIGS. 5 and 6 take waveforms that are reversed with respect to the voltage Vc.

Figure 7:
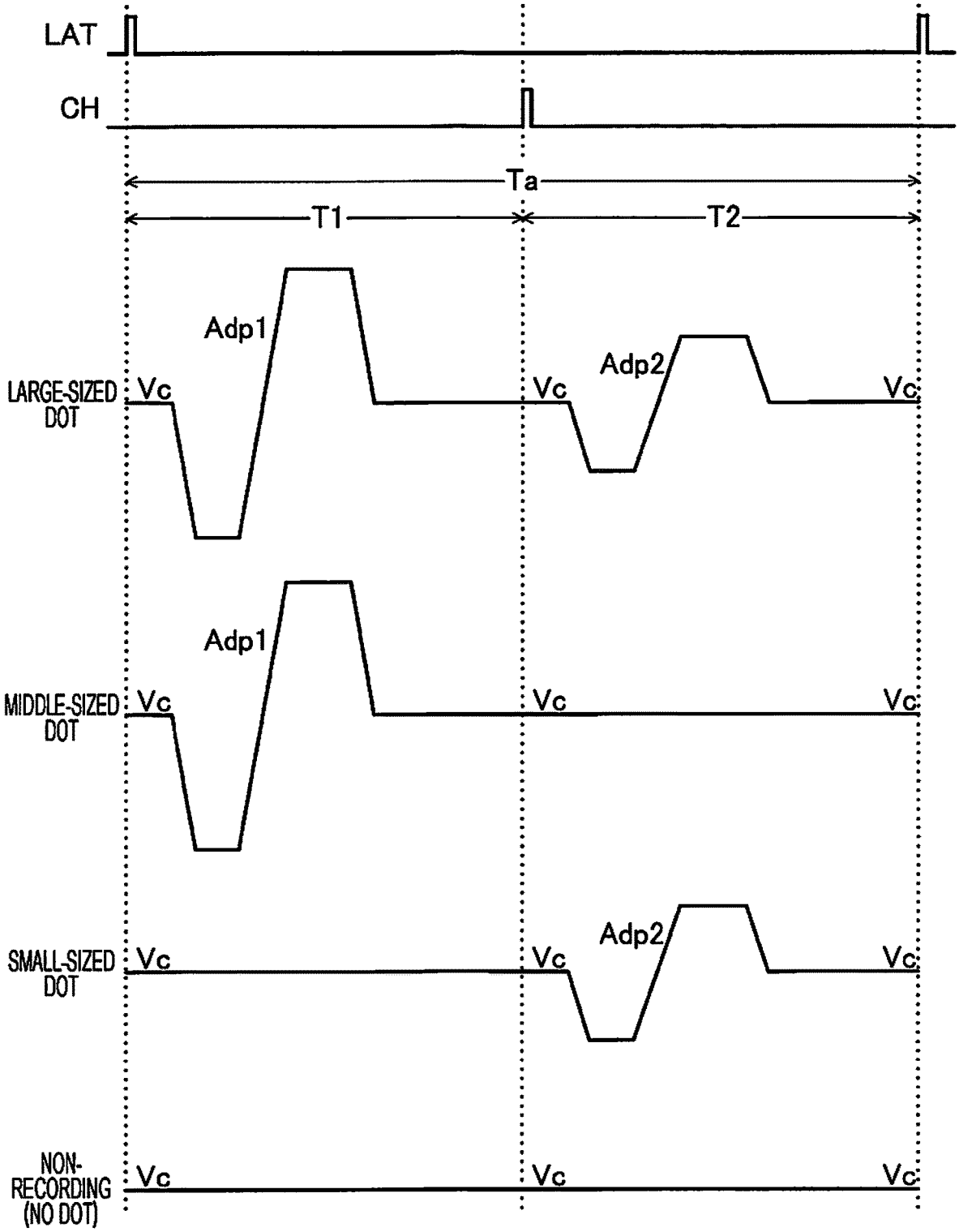
FIG. 7 is a diagram illustrating a waveform of a drive signal in a printing mode.

FIG. 7 is a diagram illustrating a waveform of the drive signal VOUT that corresponds to each of the "large-sized dot," the "middle-sized dot, the "small-sized dot," and the "non-recording."

As illustrated in FIG. 7, the drive signal VOUT that corresponds to the "large-sized dot" takes a waveform that results from successively combining the trapezoid waveform Adp1 of the drive signal COMA during the duration T1, and the trapezoid waveform Adp2 of the drive signal COMA during the duration T2. When the drive signal VOUT is supplied to one terminal of the piezoelectric element 60, at the periodicity Ta, the middle-sized amount of ink and the small-sized amount of ink are discharged over two times, one time for each, through the nozzle 651 that corresponds to the piezoelectric element 60. For this reason, the amounts of ink are landed onto the printing medium P and are combined, thereby forming a large-sized dot.

The drive signal VOUT that corresponds to the "middle-sized dot" takes the trapezoid waveform Adp1 of the drive signal COMA during the duration T1, and is at the immediately-preceding voltage Vc that is retained due to a capacitive behavior included in the piezoelectric element 60, which results from being at high impedance during the duration T2. When the drive signal VOUT is supplied to one terminal of the piezoelectric element 60, at the periodicity Ta, the middle-sized amount of ink is discharged through the nozzle 651 that corresponds to the piezoelectric element 60, only during the duration T1. For this reason, the amount of ink is landed onto the printing medium P and thus forms a middle-sized dot.

The drive signal VOUT that corresponds to the "small-sized dot is at the immediately-preceding voltage Vc that is retained due to the capacitive behavior included in the piezoelectric element 60, which results from being at high impedance during the duration T1, and takes the trapezoid waveform Adp2 of the drive signal COMA during the duration T2. When the drive signal VOUT is supplied to one terminal of the piezoelectric element 60, at the periodicity Ta, the small-sized amount of ink is discharged through the nozzle 651 that corresponds to the piezoelectric element 60, only during the duration T2. For this reason, the amount of ink is landed onto the printing medium P and thus forms a small-sized dot.

The drive signal VOUT that corresponds to the "non-recording" is at high impedance during the duration T1 and the duration T2, and because of this, is at the immediately-preceding voltage Vc that is retained due to the capacitive behavior included in the piezoelectric element 60. When the drive signal VOUT is supplied to one terminal of the piezoelectric element 60, at the periodicity Ta, ink is not discharged through the nozzle 651 that corresponds to the piezoelectric element 60. For this reason, ink is not landed onto the printing medium P, and a dot is not formed.

Figure 8:
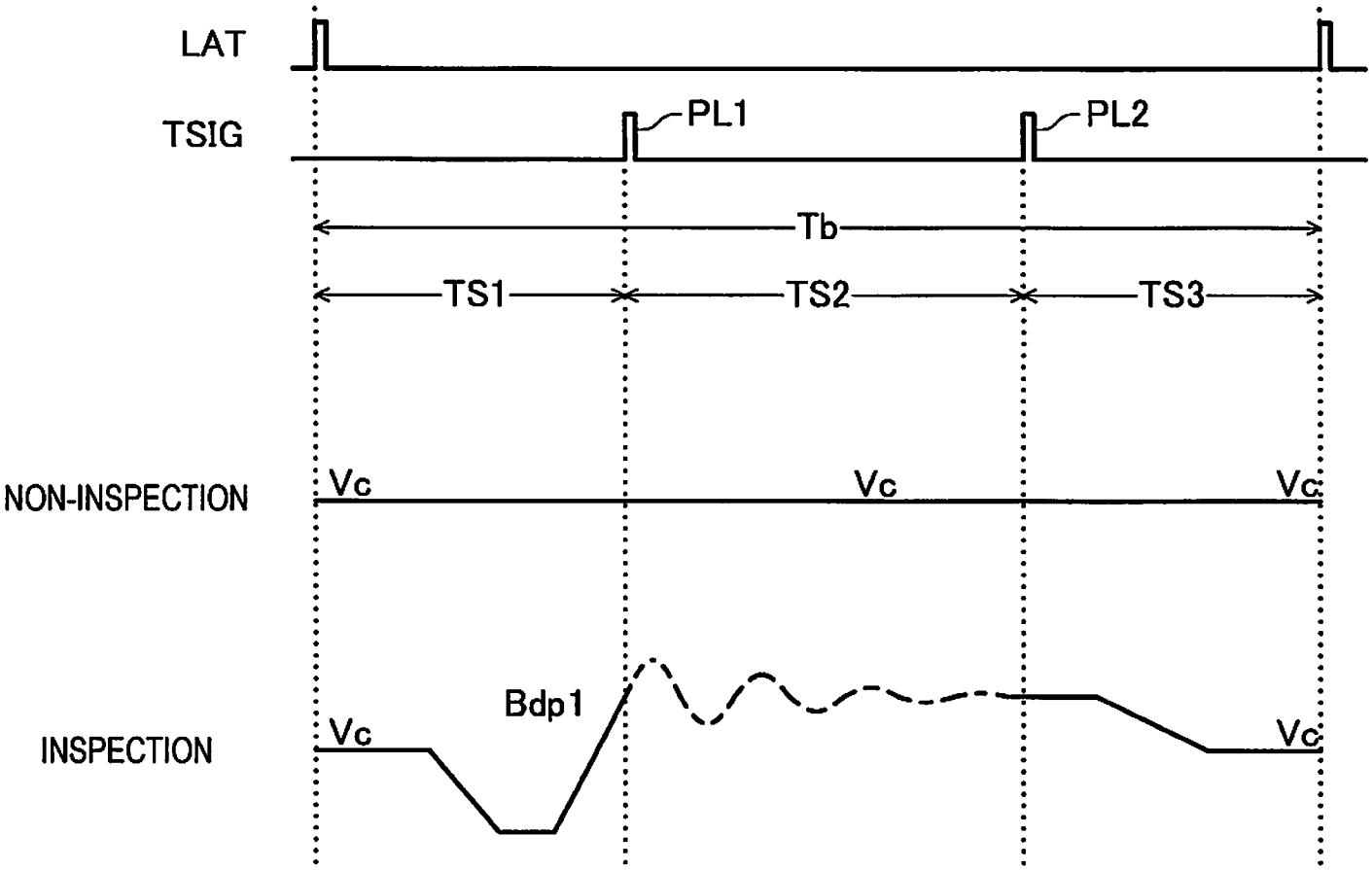
FIG. 8 is a diagram illustrating a waveform of the drive signal in an inspection mode.

FIG. 8 is a diagram illustrating a waveform of the drive signal VOUT that corresponds to "inspection" and "non-inspection". As illustrated in FIG. 8, the drive signal VOUT that corresponds to the "inspection" is a portion of the trapezoid waveform Bdp1 of the drive signal COMB during the duration TS1 and the duration TS3, and is at high impedance during the duration TS2.

When the drive signal VOUT for inspection is supplied to one terminal of the piezoelectric element 60, during the duration TS1, in the discharging section 600 having the piezoelectric element 60, the cavity 631 is drastically enlarged due to an increase on electric potential of the drive signal VOUT, and then the cavity 631 is drastically reduced due to a decrease in the electric potential of the drive signal VOUT. Thereafter, when the electric potential of the drive signal VOUT no longer increases and thus is constant, the cavity 631 returns to its original volume while being repeatedly enlarged and reduced, but at this time, vibration that is attenuated over time, that is, the residual vibration, occurs in the cavity 631. An electromotive force of the piezoelectric element 60 changes according to the residual vibration, and a residual vibration waveform appears in the drive signal VOUT during the duration TS2. Although this will be described in detail below, in the present embodiment, in the inspection circuits 90-1 to 90-4, based on the residual vibration waveform that appears in the drive signal VOUT, the discharge state of the discharging section 600 that is an inspection target is determined.

The drive signal VOUT that corresponds to the "non-inspection" is at high impedance during the durations TS1, TS2, and TS3, and, because of this, is at the immediately-preceding voltage Vc that is retained due to the capacitive behavior included in the piezoelectric element 60. Although the drive signal VOUT is supplied to one terminal of the piezoelectric element 60, vibration does not occur in the cavity 631 in the discharging section 600 that includes the piezoelectric element 60.

In the present embodiment, at each periodicity Ta, the liquid discharging apparatus 1 performs printing processing that supplies the drive signal VOUT for the "large-sized dot", the middle-sized dot", the "small-sized dot", or the "non-recording", to each discharging section 600. The liquid discharging apparatus 1 repeatedly performs the printing processing continuously or intermittently over multiple periodicities Ta and thus forms an image in accordance with image data on the printing medium P.

Furthermore, in the inspection mode, at each periodicity Tb, the liquid discharging apparatus 1 performs inspection processing that makes determinations of the supply of the drive signal VOUT and the discharge state for inspection, on each discharging section 600. The inspection processing is performed during a duration during the printing processing is performed. The duration during which the printing processing is unnecessary, for example, is a duration that comes before or after the printing processing is started, a duration from when printing of one page is ended to when printing of a next page is started, or the like.

5. Configuration of Switch Circuit

Figure 9:
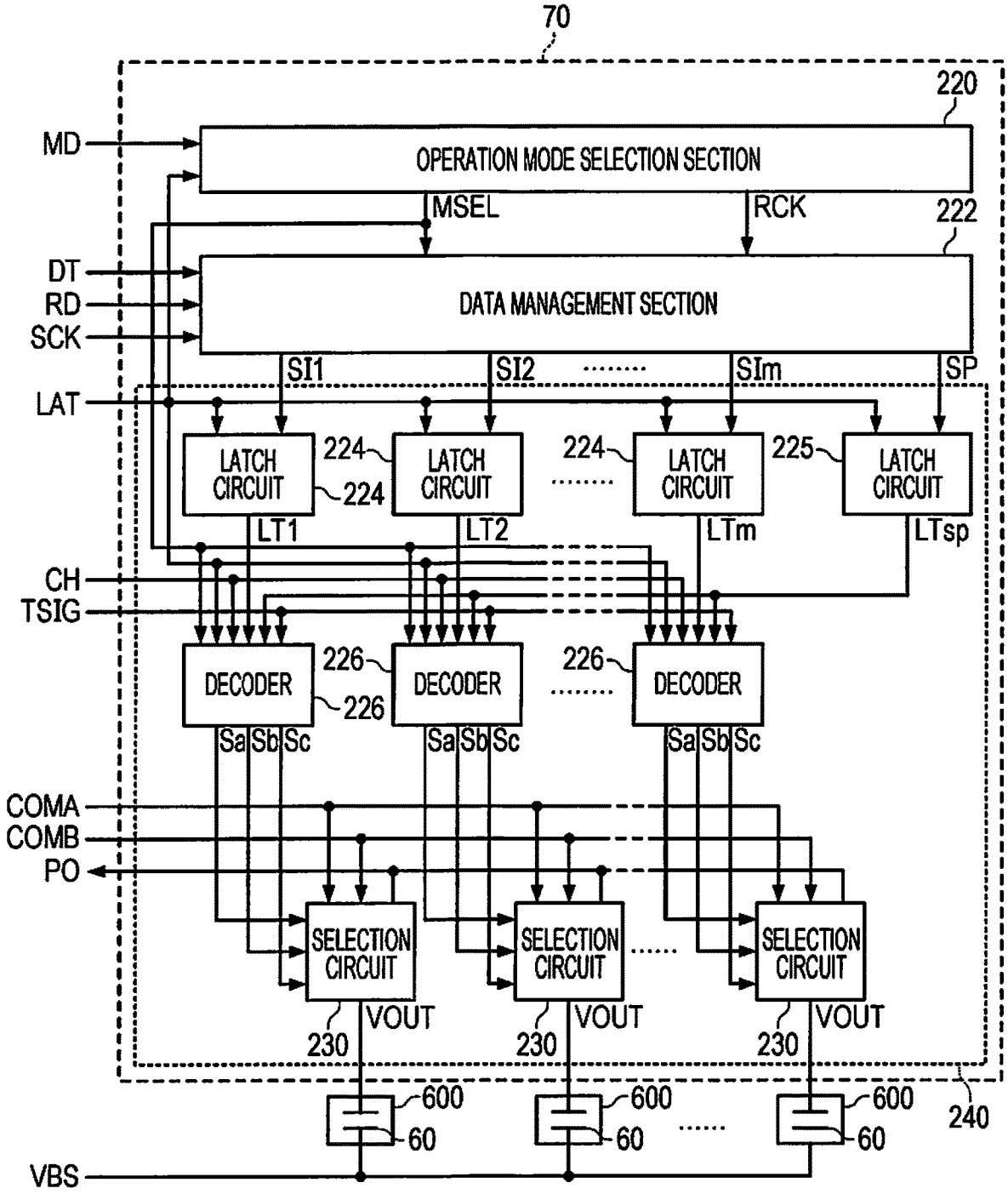
FIG. 9 is a diagram illustrating a configuration of a switch circuit.

Next, configurations of the switch circuits 70-1 to 70-4 will be described. It is hereinafter assumed that the switch circuits 70-1 to 70-4 employ the same circuit configuration, and a configuration of one switch circuit 70 is described. FIG. 9 is a diagram illustrating the configuration of the switch circuit 70. As illustrated in FIG. 9, the switch circuit 70 includes an operation mode selection section 220, a data management section 222, and a drive waveform selection section 240.

The switch circuit 70 operates in the printing mode for performing the printing processing and in the inspection mode for performing the inspection processing, as operations modes.

Based on the operation mode instruction signal MD, the operation mode selection section 220 selects any one of the printing mode and the inspection mode. Then, in the printing mode, the operation mode selection section 220 generates operation mode selection signals MSEL that are at logical levels different from each other. In the present embodiment, the operation mode selection signal MSEL is at a low level in the printing mode and is at a high level in the inspection mode. Furthermore, in the inspection mode, the operation mode selection section 220 outputs a clock signal RCK that takes a given number of pulses at every periodicity Tb that is prescribed by the latch signal LAT.

The data management section 222 manages first control data that controls a state of each of the multiple discharging sections 600, and inspection target discharging-section designation data that designates the discharging section 600 that is to be inspected, which are among the multiple discharging sections 600. The first control data is printing control data that controls the discharging of liquid from each of the multiple discharging sections 600 in the printing mode, or is inspection control data that controls whether or not each of the multiple discharging sections 600 is an inspection target, in the inspection mode. The inspection control data includes the inspection target discharging-section designation data.

Furthermore, the data management section 222 manages second control data that designates a rule in which the drive waveform selection section 240 selects the waveforms of the drive signals COMA and COMB. Input into the data management section 222 are the data signal DT, a data retention selection signal RD, the clock signal SCK, the operation mode selection signal MSEL, and the clock signal RCK. It is noted that the data signal DT is any one of the data signals DT1 to DT4.

In the present embodiment, the data signal DT includes printing data SI as the first control data, and program data SP as the second control data. The printing data SI is data that prescribes a size, that is, a gradation, of a dot that is formed on the printing medium P by a discharge operation by each of the m discharging sections 600. The integer m is the total number of the discharging sections 600 that are driven by the switch circuit 70, and is the same as the total number of the nozzles 651 that are included in two nozzle columns 650. As described above, in the present embodiment, four gradations, the "large-sized dot," the "middle-sized dot," the "small-sized dot," and the "non-recording," are prescribed. The printing data SI includes pieces of printing data SI1 to SIm on the m discharging sections 600, respectively. Furthermore, the program data SP is data for designating a rule for selecting from the drive signal COMA a drive waveform that is to be applied to the piezoelectric element 60 which is included in the discharging section 600.

The data management section 222 retains the pieces of printing data SI1 to SIm and the program data SP, which are included in the data signal DT, and outputs the retained pieces of data.

Figure 10:
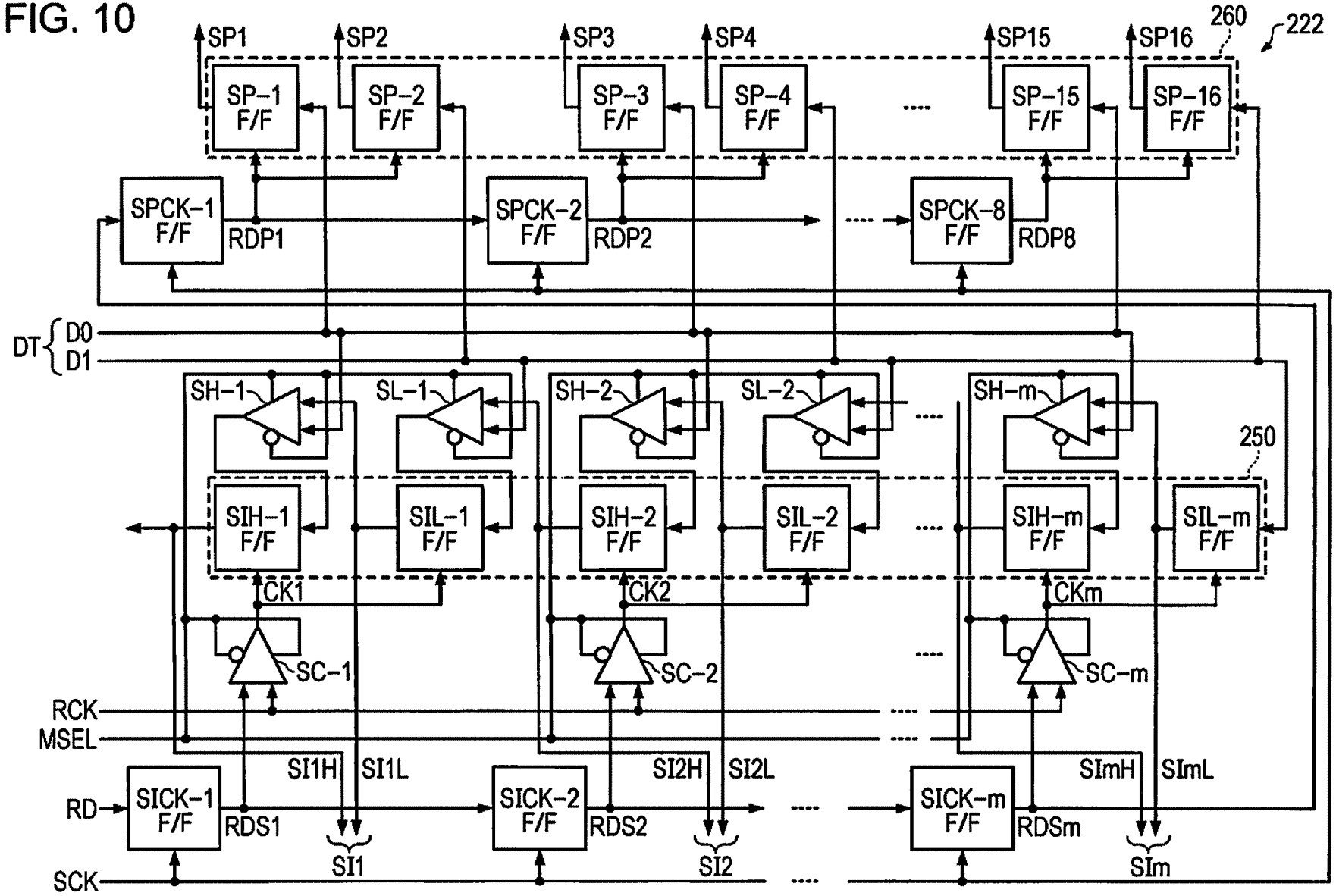
FIG. 10 is a diagram illustrating a configuration of a data management section.

FIG. 10 is a diagram illustrating a configuration of the data management section 222. As illustrated in FIG. 10, the data management section 222 includes m flip-flops SICK-1 to SICK-m and eight flip-flops SPCK-1 to SPCK-8. The flip-flop SICK-1 is synchronized to the clock signal SCK, and thus retains the data retention selection signal RD and outputs the retained data retention selection signal RD as a data retention selection signal RDS1. For an integer i ranging from 1 to m−1, the flop-flip SICK-(i+1) retains a data retention selection signal RDSi that is synchronized to the clock signal SCK, and outputs the retained data retention selection signal RDSi as a data retention selection signal RDS (i1). The flip-flop SPCK-1 retains a data retention selection signal RDSm that is synchronized to the clock signal SCK, and outputs the retained data retention selection signal RDSm as a data retention selection signal RDP1. For an integer i ranging from 1 to 7, the flip-flop SPCK-(i+1) retains a data retention selection signal RDPi that is synchronized to the clock signal SCK, and outputs the retained data retention selection signal RDPi as a data retention selection signal RDP(i+1). In this manner, the flip-flops SICK-1 to SICK-m and SPCK-1 to SPCK-8 make up a shift register that shifts data which is synchronized to the clock signal SCK.

Furthermore, the data management section 222 includes m selectors SC-1 to SC-m, m selectors SH-1 to SH-m, and (m−1) selectors SL-1 to SL-(m−1). For an integer i ranging from 1 to m, the selector SC-i selects the data retention selection signal RDSi when the operation mode selection signal MSEL is at a low level, and selects the clock signal RCK and outputs the selected signal as a clock signal CKi, when the operation mode selection signal MSEL is at a high level. For an integer i ranging from 1 to m, the selector SH-i selects bit data D0 that is included in the data signal DT, when the operation mode selection signal MSEL is at the low level, and selects data that is retained by a flip-flop SIL-i and outputs the selected data, when the operation mode selection signal MSEL is at the high level. For an integer i ranging from 1 to m−1, a selector SL-i selects bit data D1 that is included in the data signal DT, when the operation mode selection signal MSEL is at the low level, and selects data that is retained by a flip-flop SIH-(i+1) and outputs the selected data, when the operation mode selection signal MSEL is at the high level.

The data management section 222 includes a first data retention section 250. In an example in FIG. 10, the first data retention section 250 is a first register that is configured with m flip-flops SIH-1 to SIH-m for retaining pieces of m-bit printing data SI1H to SImH, respectively, and m flip-flops SIL-1 to SIL-m for retaining pieces of m-bit printing data SI1L to SImL, respectively, among pieces of 2m-bit printing data SI. For an integer i ranging from 1 to m, a flip-flop SIH-i retains data that is synchronized to the clock signal CKi and is to be output from the selector SH-i. Furthermore, for an integer i ranging from 1 to m−1, the flip-flop SIL-i retains data that is synchronized to the clock signal CKi and is to be output from the selector SL-i. The flip-flop SIL-m retains the bit data D1 that is synchronized to the clock signal CKi. The flip-flops SIH-1 to SIH-m output pieces of data that are retained, as the pieces of printing data SI1H to SImH, respectively. Furthermore, the flip-flops SIL-1 to SIL-m output pieces of data that are retained, as the pieces of printing data SI1L to SImL, respectively. Then, for an integer i ranging from 1 to m, the pieces of printing data SIiH and SIiL are output as pieces of printing data SIi to the drive waveform selection section 240.

Furthermore, the data management section 222 includes a second data retention section 260. In an example in FIG. 10, the second data retention section 260 is a second register that is configured with 16 flip-flops SP-1 to SP-16 for retaining pieces of program data SP1 to SP16, respectively, that make up 16-bit program data SP. For an integer i ranging from 1 to 8, the flip-flop SP-(2*i*-1) retains the bit data D0 that is synchronized to the data retention selection signal RDPi. Furthermore, for an integer i ranging from 1 to 8, the flip-flop SP-(2*i*) retains the bit data D1 that is synchronized to the data retention selection signal RDPi. The flip-flops SP-1 to SP-16 output pieces of data that are retained, as the pieces of program data SP1 to SP16, respectively. Then, the pieces of program data SP1 to SP16 are provided as the 16-bit program data SP to the drive waveform selection section 240.

Figure 11:
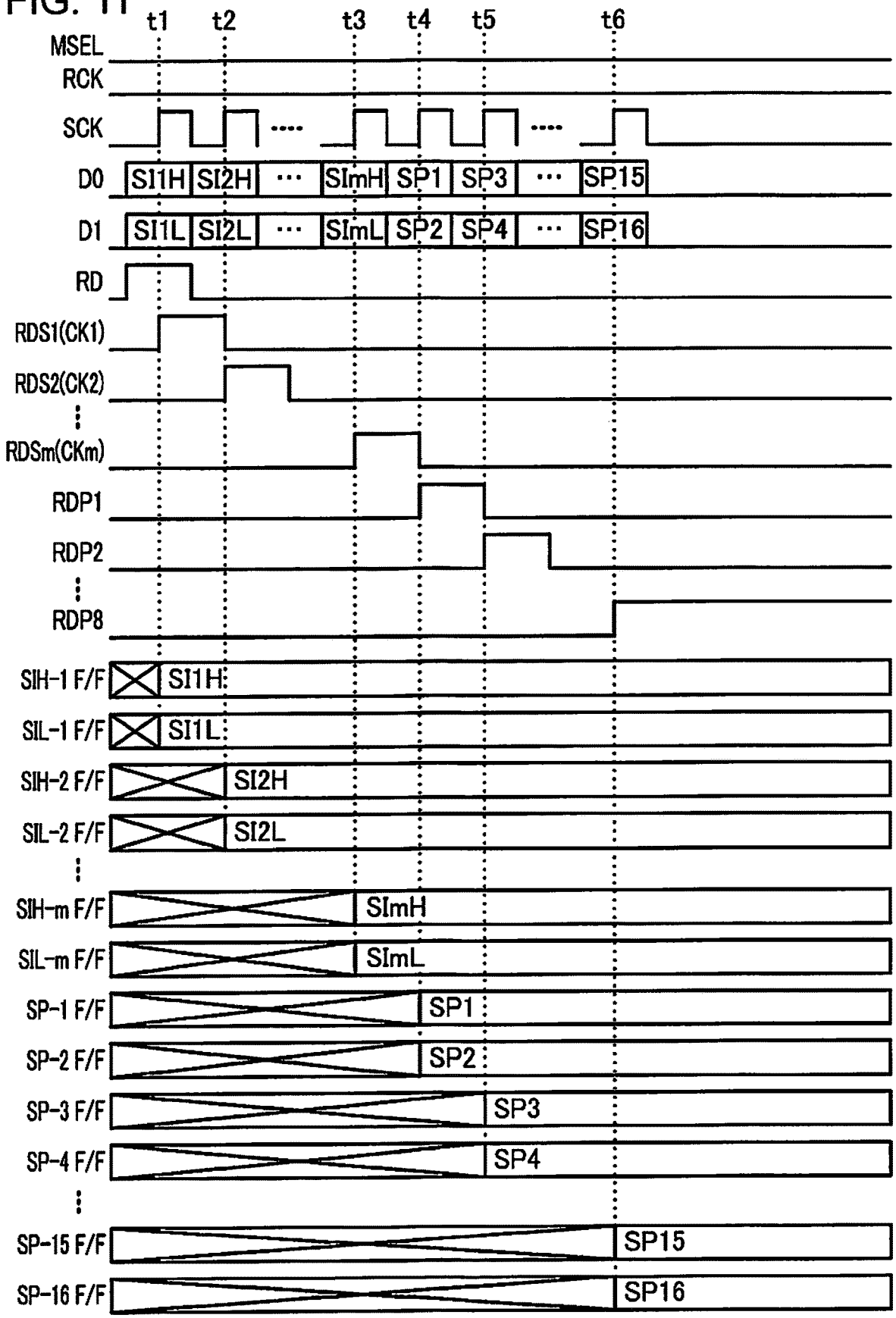
FIG. 11 is a timing chart diagram illustrating an example of operation of the data management section.

FIG. 11 is a timing chart diagram illustrating an example of operation of the data management section 222 that is performed when the operation mode selection signal MSEL is at the low level.

In an example in FIG. 11, an operation mode of the switch circuit 70 is a printing mode, and the operation mode selection section 220 outputs the low-level operation mode selection signal MSEL to the data management section 222. Furthermore, the control section 111 transmits the clock signal SCK that includes m+8 high pulses, the data retention selection signal RD that includes one high pulse, and the data signal DT that includes the pieces of bit data D0 and D1, to the data management section 222. The bit data D0 includes the pieces of printing data and the pieces of program data in this order: SI1H, SI2H, and so forth up to SImH, SP1, SP3, and so forth up to SP15. Furthermore, the bit data D1 includes the pieces of printing data and the pieces of program data in this order: SI1L, SI2L, and so forth up to SImL, SP2, SP4, and so forth up to SP16.

At time t1, because the data retention selection signal RD is at the high level, when the clock signal SCK is on the rising edge, the data retention selection signal RDS1 changes from the low level to the high level. With the selector SC-1, because the data retention selection signal RDS1 is selected, the clock signal CK1 also changes from the low level to the high level.

Furthermore, in time t1, because the bit data D0 is the printing data SI1H, when the clock signal CK1 is on the rising edge, the printing data SI1H is retained in the flip-flop SIH-1. In the same manner, at time t1, because the bit data D1 is the printing data SI1L, when the clock signal CK1 is on the rising edge, the printing data SI1L is retained in the flip-flop SIL-1.

At time t2, because the data retention selection signal RDS1 is at the high level, when the clock signal SCK is on the rising edge, the data retention selection signal RDS2 changes from the low level to the high level. With the selector SC-2, the data retention selection signal RDS2 is selected, and because of this, a clock signal CK2 also changes from the low level to the high level. Furthermore, at time t2, because the data retention selection signal RD is at the low level, when the clock signal SCK is on the rising edge, the data retention selection signal RDS1 changes from the high level to the low level. Accordingly, the clock signal CK1 also changes from the high level to the low level.

Furthermore, at time t2, because the bit data D0 is the printing data SI2H, when the clock signal CK2 is on the rising edge, the printing data SI2H is retained in the flip-flop SIH-2. In the same manner, at time t2, because the bit data D1 is the printing data SI2L, when the clock signal CK2 is on the rising edge, the printing data SI2L is retained in the flip-flop SIL-2.

Thereafter, until time t3, each time the clock signal SCK is on the rising edge, the data retention selection signals RDS3 to RDSm change sequentially from the low level to the high level, and accordingly, the clock signals CK3 to CKm also changes sequentially from the low level to the high level. Furthermore, when the clock signals CK3 to CKm are on the rising edge, the pieces of printing data SI3H to SImH are retained in the flip-flops SIH-3 to SIH-m, respectively, and the pieces of printing data SI3L to SImL are retained in the flip-flops SIL-3 to SIL-m, respectively.

At time t4, because the data retention selection signal RDSm is at the high level, when the clock signal SCK is on the rising edge, the data retention selection signal RDP1 changes from the low level to the high level. Furthermore, at time t4, because the data retention selection signal RDS (m−1) is at the low level, when the clock signal SCK is on the rising edge, the data retention selection signal RDSm changes from the high level to the low level. Accordingly, the clock signal CKm also changes from the high level to the low level.

Furthermore, at time t4, because the bit data D0 is the program data SP1, when the data retention selection signal RDP1 is on the rising edge, the program data SP1 is retained in the flip-flop SP-1. In the same manner, at time t4, because the bit data D1 is the program data SP2, when the data retention selection signal RDP1 is on the rising edge, the program data SP2 is retained in the flip-flop SP-2.

At time t5, because the data retention selection signal RDP1 is at the high level, when the clock signal SCK is on the rising edge, the data retention selection signal RDP2 changes from the low level to the high level. Furthermore, at time t5, because the data retention selection signal RDSm is at the low level, when the clock signal SCK is on the rising edge, the data retention selection signal RDP1 changes from the high level to the low level.

Furthermore, at time t5, because the bit data D0 is the program data SP3, when the data retention selection signal RDP2 is on the rising edge, the program data SP3 is retained in the flip-flop SP-3. In the same manner, at time t5, because the bit data D1 is the program data SP4, when the data retention selection signal RDP2 is on the rising edge, the program data SP4 is retained in the flip-flop SP-4.

Thereafter, until time t6, each time the clock signal SCK is on the rising edge, the data retention selection signal RDP3 to RDP8 change sequentially from the low level to the high level. Furthermore, when the data retention selection signals RDP3 to RDP8 are on the rising edge, the pieces of program data SP5, the SP7, SP9, SP11, SP13, and SP15 are retained in the flip-flops SP-5, SP-7, SP-9, SP-11, SP-13, and SP-15, respectively, and the pieces of program data SP6, the SP8, SP10, SP12, SP14, and SP16 are retained in the flip-flops SP-6, SP-8, SP-10, SP-12, SP-14, and SP-16, respectively.

In this manner, when the operation mode selection signal MSEL is at the low level, the data management section 222 operates at a first transfer mode in which the printing data SI that is included in the data signal DT is parallelly transferred to the first data retention section 250. That is, in the printing mode, the data management section 222 operates in the first transfer mode. Specifically, in the first transfer mode, the data management section 222 sequentially selects each bit from the first data retention section 250, transfers the pieces of printing data SI1H, SI1L to SImH, and SImL, which are pieces of bit data of the pieces of printing data SI, respectively, to each selected bit, and thus parallelly transfers the printing data SI to the first data retention section 250. Furthermore, in the first transfer mode, the data management section 222 parallelly transfers the program data SP that is included in the data signal DT, to the second data retention section 260. Specifically, in the first transfer mode, the data management section 222 sequentially selects each bit from the second data retention section 260, transfers the pieces of program data SP1 to SP16, which are pieces of bit data of the pieces of program data SP, respectively, to each selected bit, and thus parallelly transfers the program data SP to the second data retention section 260.

It is noted that in an example in FIG. 11, the control section 111 transmits the printing data SI, and then transmits the program data SP, but that if the rule in which the drive waveform selection section 240 selects the waveform of the drive signal COMA is not changed, because the program data SP is not changed, the program data SP may not be transmitted.

Figure 12:
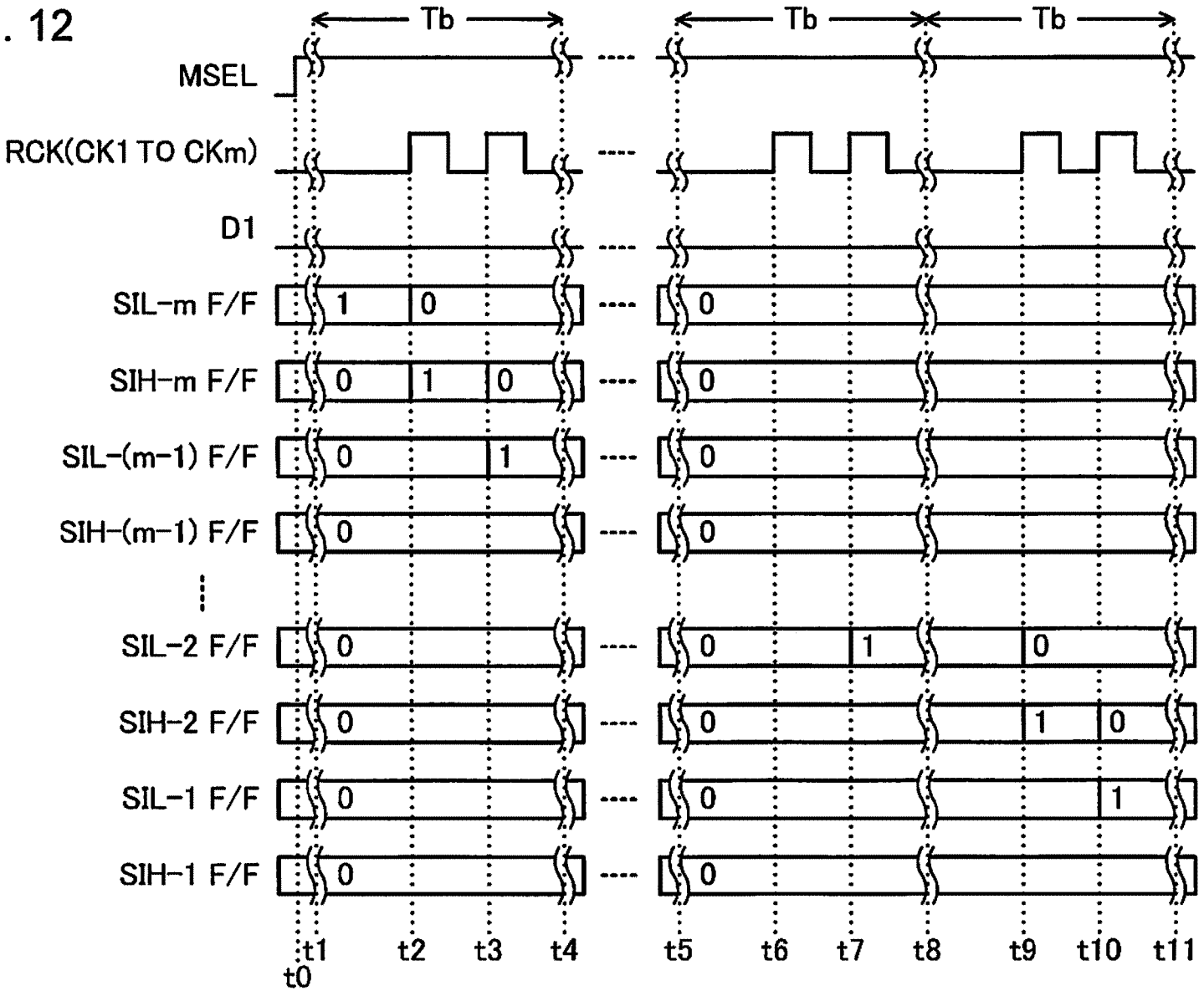
FIG. 12 is a timing chart diagram illustrating an example of the operation of the data management section.

FIG. 12 is a flowchart diagram illustrating an example of the operation of the data management section 222 that is performed when the operation mode selection signal MSEL is at the high level.

In an example in FIG. 12, before time to, the operation mode of the switch circuit 70 is a printing mode, and the operation mode selection section 220 outputs the low-level operation mode selection signal MSEL to the data management section 222. At time t0 or later, the operation mode of the switch circuit 70 is an inspection mode, and the operation mode selection section 220 outputs the high-level operation mode selection signal MSEL to the data management section 222. Furthermore, the operation mode selection section 220 outputs the clock signal RCK including two high pulses, to the data management section 222 at every periodicity Tb. Furthermore, the control section 111 transmits the data signal DT including the low-level bit data D1 to the data management section 222. It is noted that when the operation mode selection signal MSEL is at the high level, because the clock signal SCK, the data retention selection signal RD, and the bit data D0 are not influenced by the operation of the data management section 222, the control section 111 can arbitrarily set logical levels of these signals.

Before time t0, because the operation mode selection signal MSEL is at the low level, the data management section 222 operates in the first transfer mode and the printing data SI is retained in the first data retention section 250. In the example in FIG. 12, in the first data retention section 250, the two-bit printing data SIm that is retained in the flip-flops SIH-m and SILm is (0, 1), and the other pieces of printing data SI1 to SI(m−1) are all (0, 0).

At time t0, the operation mode of the switch circuit 70 transitions from the printing mode to the inspection mode, and the operation mode selection signal MSEL changes from the high level to the low level. Accordingly, at time t0 or later, the data management section 222 operates in a second transfer mode.

At time t1 at which an initial periodicity Tb starts, the printing data SI1 is also (0, 1), and the other pieces of printing data SI2 to SIm are all (0, 0). In the present embodiment, in the inspection mode, for an integer i ranging from 1 to m, when the printing data SIi that is retained in the first data retention section 250 at the time of the starting of the periodicity Tb is (0, 1), an i-th discharging section 600, which is among the m discharging sections 600, is an inspection target during the periodicity Tb, and when the printing data SIi is (0, 0), the i-th discharging section 600 is not an inspection target during the periodicity Tb. That is, during the periodicity Tb that starts from time t1, an m-th discharging section 600 is an inspection target, and the other discharging sections 600 are not inspection targets. That is, two-bit data (0, 1) is inspection target discharging-section designation data that designates the discharging section 600 that is to be inspected.

At time t2, the clock signal RCK changes from the low level to the high level. Because the clock signal RCK is selected by the selectors SC-1 to SC-m, the clock signals CK1 to CKm also change from the low level to the high level.

Furthermore, at time t2, data that is retained in the flip-flop SIL-m is selected by the selector SH-m, and the data is 1. Because of this, when the clock signal CKm is on the rising side, data that is retained SIH-m changes from 0 to 1. Furthermore, at time t2, because the bit data D0 is at the low level, when the clock signal CKm is on the rising edge, data that is retained in the flip-flop SIL-m changes from 1 to 0.

At time t3, the clock signal RCK changes from the low level to the high level, and the clock signals CK1 to CKm also change from the low level to the high level.

Furthermore, at time t3, data that is retained in the flip-flop SIH-m is selected by the selector SL-(m−1), and the data is 1. Because of this, when the clock signal CK(m−1) is on the rising side, data that is retained in the flip-flop SIL-(m−1) changes from 0 to 1. Accordingly, in the first data retention section 250, the two-bit printing data SI (m−1) that is retained in the flip-flops SIH-(m−1) and SIL-(m−1) is (0, 1), and the other pieces of printing data SI1 to SI(m−2) and SIm are all (0, 0). In this manner, in the first data retention section 250, when the clock signals RCK is two times on the rising edge, one at time t2 and the other at time t3, inspection target discharging-section designation data (0, 1) is shifted. As a result, during a next periodicity Tb that starts from time t4, an (m−1)-th discharging section 600 is an inspection target, and the other discharging sections 600 are not inspection targets.

Thereafter, until time t5, when the clock signal RCK is two times on the rising edge during each periodicity Tb, the inspection target discharging-section designation data (0, 1) is shifted, (m−2)-th to 4-th discharging sections 600 are sequentially inspection targets, and during the periodicity Tb that starts from time t5, a third discharging section 600 is an inspection target.

Time t6 and time t7, the clock signal RCK changes from the low level to the high level and the clock signals CK1 to CKm also change from the low level to the high level.

Furthermore, at time t7, data that is retained in the flip-flop SIH-3 is selected by the selector SL-2, and the data is 1. Because of this, when the clock signal CK2 is on the rising edge, data that is retained in the flip-flop SIL-2 changes from 0 to 1. Accordingly, in the first data retention section 250, the two-bit printing data SI2 that is retained in the flip-flops SIH-2 and SIL-2 is (0, 1), and the other pieces of printing data SI1 and SI3 to SIm are all (0, 0). As a result, during a next periodicity Tb that starts from time t8, a second discharging section 600 is an inspection target, and the other discharging sections 600 are not inspection targets.

At time t9, the clock signal RCK changes from the low level to the high level, and the clock signals CK1 to CKm also change from the low level to the high level.

Furthermore, at time t9, data that is retained in the flip-flop SIL-2 is selected by the selector SH-2, and the data is 1. Because of this, when the clock signal CK1 is on the rising edge, data that is retained in the flip-flop SIH-2 changes from 0 to 1. Furthermore, at time t9, the data that is retained in the flip-flop SIH-3 is selected by the selector SL-2, and the data is 0. Because of this, when the clock signal CK2 is on the rising edge, the data that is retained in the flip-flop SIL-2 changes from 0 to 1.

At time t10, the clock signal RCK changes from the low level to the high level, and the clock signals CK1 to CKm also change from the low level to the high level.

Furthermore, at time t10, data that is retained in the flip-flop SIH-2 is selected by the selector SL-1, and the data is 1. Because of this, when the clock signal CK1 is on the rising edge, data that is retained in the flip-flop SIL-1 changes from 0 to 1. Accordingly, in the first data retention section 250, the two-bit printing data SI1 that is retained in the flip-flops SIH-1 and SIL-1 is (0, 1), and the other pieces of printing data and SI2 to SIm are all (0, 0). In this manner, in the first data retention section 250, when the clock signals RCK is two times on the rising edge, one at time t9 and the other at time t10, the inspection target discharging-section designation data (0, 1) is shifted. As a result, during a next periodicity Tb that starts from time t11, a first discharging section 600 is an inspection target, and the other discharging sections 600 are not inspection targets.

In this manner, when the operation mode selection signal MSEL is at the high level, the data management section 222 operates in the second transfer mode in which the first data retention section 250 is caused to operate as a shift register that serially transfers the inspection target discharging-section designation data (0, 1). That is, in the inspection mode, the data management section 222 operates in the second transfer mode. Then, the inspection target discharging-section designation data (0, 1) is two bits long, and because the printing data SI is 2m bits long, a size of the inspection target discharging-section designation data (0, 1) is smaller than a size of the printing data SI. Therefore, a data transfer time in the second transfer mode can be shortened than a data transfer time in the first transfer mode. As a result, the periodicity Tb can be shortened, and the time it takes to inspect the m discharging sections 600 can be shortened.

Furthermore, in the second transfer mode, the data management section 222 retains the program data SP in the second data retention section 260. That is, in the second transfer mode, the data management section 222 does not cause the second data retention section 260 to operate as a shift register, and for that reason, updating on the program data SP that is retained in the second data retention section 260 is not performed. Therefore, in the inspection mode, electric power that is consumed in the second data retention section 260 is reduced. Furthermore, after the transitioning from the inspection mode to the printing mode takes place, the control section 111 does not need to transmit the program data SP to the data management section 222, and after the transitioning to the printing mode takes place, electric power that is consumed in the second data retention section 260 is also reduced.

It is noted that, when switching from the printing mode to the inspection mode takes place, in the first transfer mode, the data management section 222 may transfer pieces of printing data SI, as pieces of inspection control data, to the first data retention section 250, and then may make the transition from the first transfer mode to the second transfer mode.

With reference again to FIG. 9, the drive waveform selection section 240 includes m latch circuits 224, m latch circuits 225, m decoders 226, and m selections circuits 230, and, based on data that is retained by the first data retention section 250 and data that is retained by the second data retention section 260, selects a waveform of a drive signal for each of the m discharging sections 600. The latch circuit 224, the decoder 226, and the selection circuit 230 are provided in a manner that corresponds to each of the discharging sections 600. That is, each of the numbers of the latch circuits 224, the decoder 226, and the selection circuits 230, which are included in one switch circuit 70, is the total number of the discharging sections 600 that are driven by the switch circuit 70.

The m latch circuits 224 latches the pieces of two-bit printing data SI1 to SIm, which are supplied from the data management section 222, respectively, when the latch signal LAT is in the rising phase. Pieces of latch data LT1 to LTm that are output from the m latch circuits 224, respectively, correspond to the pieces of printing data SI1 to SIm, respectively.

The latch circuit 225 latches the 16-bit program data SP, which is supplied from the data management section 222, when the latch signal LAT is in the rising phase. Latch data LTsp that is output from the latch circuit 225 corresponds to the program data SP.

The m decoders 226 decode the pieces of latch data LT1 to LTm, which are latched by the m latch circuits 224, respectively, that is, the pieces of printing data SI1 to SIm, respectively. Then, when the operation mode selection signal MSEL is at the low level, that is, when the operation mode is the printing mode, based on the result of the decoding and on the program data SP latched by the latch circuit 225, each of the m decoders 226 outputs selection signals Sa, Sb, and Sc during each of the durations T1 and T2 that are prescribed with the latch signal LAT and the change signal CH. Furthermore, when the operation mode selection signal MSEL is at the high level, that is, when the operation mode is the inspection mode, based on the result of the decoding, each of the m decoders 226 outputs the selection signals Sa, Sb, and Sc during each of the durations TS1, TS2, and TS3 that are prescribed with the latch signal LAT and the inspection control signal TSIG.

FIG. 13 is a diagram illustrating a detail of the decoding by the decoder 226 in the printing mode. As illustrated in FIG. 13, if 2-two-bit printing data SI=(SIH, SIL), which is latched, is (1, 1) indicating the "large-sized dot," according to pieces of 4-four-bit program data SP1 to SP4=1100, the decoder 226 outputs the selection signal Sa as being at the high level, during any one of the durations T1 and T2 and outputs the selection signal Sb as being at the low level during any one of the durations T1 and T2. In this manner, the program data SP1 prescribes a logical level of the selection signal Sa during the duration T1 when printing data SI=(1, 1). Furthermore, the program data SP2 prescribes the logical level of the selection signal Sa during the duration T2 when printing data SI=(1, 1). Furthermore, the program data SP3 prescribes a logical level of the selection signal Sb during the duration T1 when printing data SI=(1, 1). Furthermore, the program data SP4 prescribes the logical level of the selection signal Sb during the duration T2 when printing data SI=(1, 1).

Furthermore, if 2-two-bit printing data SI=(SIH, SIL) is (1, 0) indicating the "middle-sized dot," according to pieces of 4-four-bit program data SP5 to SP8=1000, the decoder 226 outputs the selection signal Sa as being at the high level, during the duration T1, outputs the selection signal as being at the low level, during the duration T2, and outputs the selection signal Sb as being at the low level during any one of the durations T1 and T2. In this manner, the program data SP5 prescribes the logical level of the selection signal Sa during the duration T1 when printing data SI=(1, 0). Furthermore, the program data SP6 prescribes the logical level of the selection signal Sa during the duration T2 when printing data SI=(1, 0). Furthermore, the program data SP7 prescribes the logical level of the selection signal Sb during the duration T1 when printing data SI=(1, 0). Furthermore, the program data SP8 prescribes the logical level of the selection signal Sb during the duration T2 when printing data SI=(1, 0).

Furthermore, if 2-two-bit printing data SI=(SIH, SIL) is (0, 1) indicating the "small-sized dot," according to pieces of 4-four-bit program data SP9 to SP12=0100, the decoder 226 outputs the selection signal Sa as being at the low level, during the duration T1, outputs the selection signal Sa as being at the high level, during the duration T2, and outputs the selection signal Sb as being at the low level during any one of the durations T1 and T2. In this manner, the program data SP9 prescribes the logical level of the selection signal Sa during the duration T1 when printing data SI=(0, 1). Furthermore, the program data SP10 prescribes the logical level of the selection signal Sa during the duration T2 when printing data SI=(0, 1). Furthermore, the program data SP11 prescribes the logical level of the selection signal Sb during the duration T1 when printing data SI=(0, 1). Furthermore, the program data SP12 prescribes the logical level of the selection signal Sb during the duration T2 when printing data SI=(0, 1).

Furthermore, if 2-two-bit printing data SI=(SIH, SIL) is (0, 0) indicating the "non-recording," according to pieces of 4-four-bit program data SP13 to SP16=0000, the decoder 226 outputs the selection signal Sa as being at the low level, during any one of the durations T1 and T2, and outputs the selection signal Sb as being at the low level during any one of the durations T1 and T2. In this manner, the program data SP13 prescribes the logical level of the selection signal Sa during the duration T1 when printing data SI=(0, 0). Furthermore, the program data SP14 prescribes the logical level of the selection signal Sa during the duration T2 when printing data SI=(0, 0). Furthermore, the program data SP15 prescribes the logical level of the selection signal Sb during the duration T1 when printing data SI=(0, 0). Furthermore, the program data SP16 prescribes the logical level of the selection signal Sb during the duration T2 when printing data SI=(0, 0).

It is noted that in the printing mode, a logical level of the selection signal Sc during the durations T1 and T2 is the same as the logical level of the selection signal Sb.

FIG. 14 is a diagram illustrating a detail of the coding by the decoder 226 in the inspection mode. As illustrated in FIG. 14, if two bit printing data SI=(SIH, SIL), which is latched, is (0, 0) indicating the "non-inspection," the decoder 226 outputs the selection signals Sa, Sb, and Sc as being at the low level during any one of the durations TS1, TS2, and TS3.

Furthermore, if two bit printing data (SIH, SIL) is (0, 1) indicating the "inspection," the decoder 226 outputs the selection signals Sa as being at the low level, during any one of the durations TS1, TS2, and TS3. Furthermore, the decoder 226 outputs the selection signal Sb as being at the high level, during the durations TS1 and TS3, output the selection signal Sb as being at the low level during the duration TS2, outputs the selection signal Sc being at the low level, during the durations TS1 and TS3, and outputs the selection signal Sc as being at the high level during the duration TS2.

High-level voltages of the selection signals Sa, Sb, and Sc that are output from the decoder 226 are level-shifted by a register, which is not illustrated, from a voltage in the vicinity of a low power source voltage VDD to a voltage in the vicinity of a high power source voltage VHV, and the resulting selection signals Sa, Sb, and Sc are supplied to the selection circuit 230.

With reference again to FIG. 9, the selection circuit 230 is provided in a manner that corresponds to each of the piezoelectric elements 60. That is, the number of the selection circuits 230 that are included in one switch circuit 70 is the same as the total number m of the nozzles 651 that are included in two nozzle columns 650.

Figure 15:
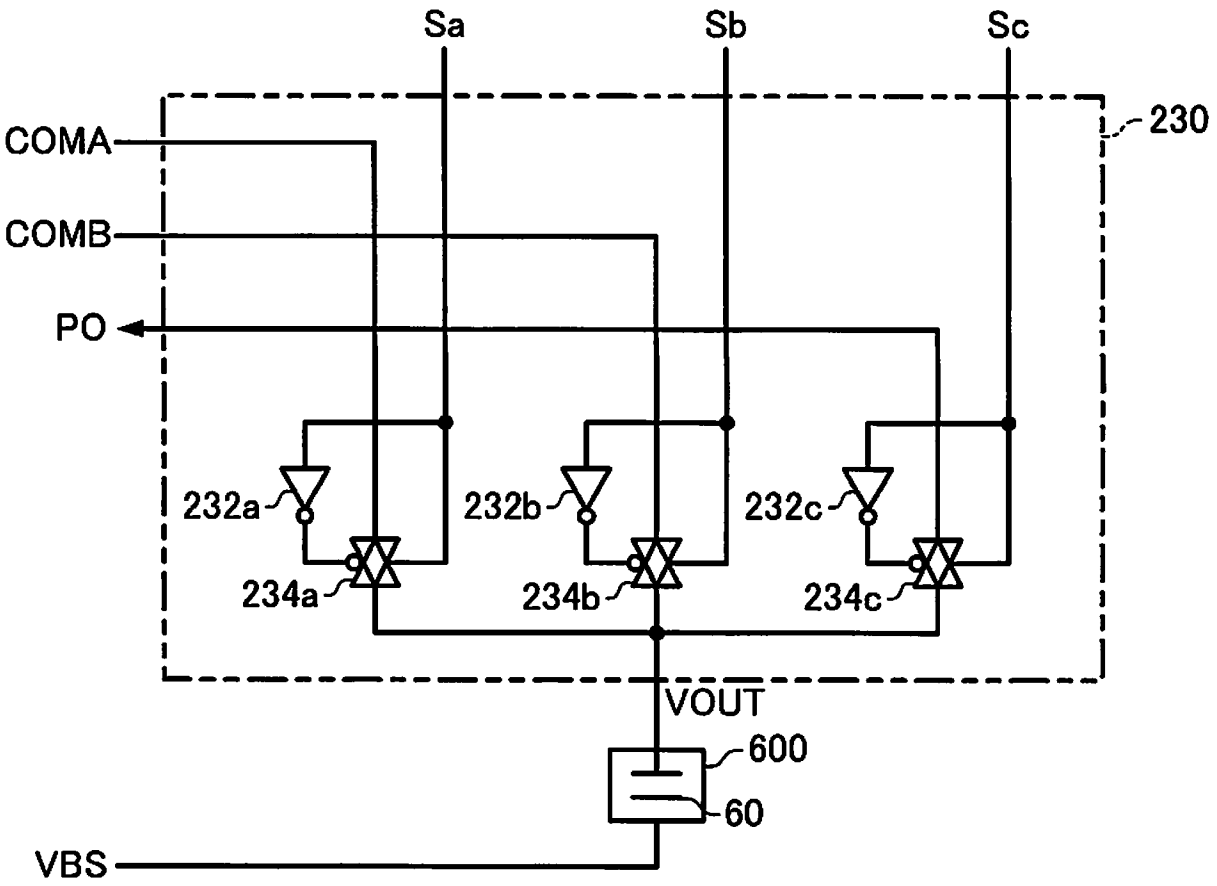
FIG. 15 is a diagram illustrating a configuration of a selection circuit.

FIG. 15 is a diagram illustrating a configuration of the selection circuit 230. The selection circuit 230, as illustrated in FIG. 15, includes inverters 232*a*, 232*b*, and 232*c*, and transfer gates 234*a*, 234*b*, and 234*c*.

The selection signal Sa from the decoder 226 is supplied to a positive control terminal of the transfer gate 234*a*. On the other hand, the selection signal Sa is logic-inverted by the inverter 232*a* and the resulting selection signal Sa is supplied to a negative control terminal of the transfer gate 234*a*. In the same manner, the selection signal Sb is a positive control terminal of the transfer gate 234*b*. On the other hand, the selection signal Sb is logic-inverted by the inverter 232*b* and the resulting selection signal Sb is supplied to a negative control terminal of the transfer gate 234*b*. In the same manner, the selection signal Sc is supplied to a positive control terminal of the transfer gate 234*c*. On the other hand, the selection signal Sb is logic-inverted by the inverter 232*c* and is supplied to a negative control terminal of the transfer gate 234*c*.

The drive signal COMA is supplied to an input terminal of the transfer gate 234*a*, and the drive signal COMB is supplied to an input terminal of transfer gate 234*b*. Output terminals of the transfer gates 234*a* and 234*b* are connected in common and are connected to one terminal of the piezoelectric element 60 that is included in the discharging section 600.

Furthermore, an input terminal of the transfer gate 234*c* is connected not only to output terminals of the transfer gates 234*a* and 234*b*, but also to one terminal of the piezoelectric element 60 that is included in the discharging section 600. As illustrated in FIG. 9, an output terminal of the transfer gate 234*c* is connected in common to output terminals of the transfer gates 234*c* of the other selection circuits 230 that are included in the switch circuit 70.

The transfer gate 234*a* makes a conductive connection between the input terminal and the output terminal thereof if the selection signal Sa is at the high level, and does not make a conductive connection between the input terminal and the output terminal thereof if the selection signal Sa is at the low level. That is, the transfer gate 234*a* is turned on if the selection signal Sa is at the high level, and the transfer gate 234*a* is turned off if the selection signal Sa is at the low level. In the same manner, the transfer gates 234*b* and 234*c* are also turned on or off according to the selection signals Sb and Sc.

The transfer gate 234*a* is turned on and thus the drive signal COMA is supplied, as the drive signal VOUT, to one terminal of the piezoelectric element 60. The transfer gate 234*b* is turned on and thus the drive signal COMB is supplied, as the drive signal VOUT, to one terminal of the piezoelectric element 60. Furthermore, the transfer gate 234*c* is turned on and thus one terminal of the piezoelectric element 60 and an input terminal of the waveform shaping circuit 80 are connected electrically.

As illustrated in FIG. 13, in the printing mode, when the printing data SI is (1, 1), the selection circuit 230 turns on the transfer gate 234*a* and thus selects the drive signal COMA, because the selection signal Sa is at the high level during the duration T1, and turns on the transfer gate 234*a* and thus selects the drive signal COMA, because the selection signal Sa is also at the high level during the duration T2. Furthermore, because the selection signal Sb is at the low level during the durations T1 and T2, the selection circuit 230 turns off the transfer gate 234*b* and thus does not select the drive signal COMB. Furthermore, because the selection signal Sc is at the low level during the durations T1 and T2, the selection circuit 230 turns off the transfer gate 234*c*. As a result, the drive signal VOUT that corresponds to the "large-sized dot" that is illustrated in FIG. 7 is generated.

Furthermore, in the printing mode, when the printing data SI is (1, 0), the selection circuit 230 turns on the transfer gate 234*a* and thus selects the drive signal COMA, because the selection signal Sa is at the high level during the duration T1, and turns off the transfer gate 234*a* and thus does not select the drive signal COMA, because the selection signal Sa is at the low level during the duration T2. Furthermore, because the selection signal Sb is at the low level during the durations T1 and T2, the selection circuit 230 turns off the transfer gate 234*b* and thus does not select the drive signal COMB. Furthermore, because the selection signal Sc is at the low level during the durations T1 and T2, the selection circuit 230 turns off the transfer gate 234*c*. As a result, the drive signal VOUT that corresponds to the "middle-sized dot" that is illustrated in FIG. 7 is generated.

Furthermore, in the printing mode, when the printing data SI is (0, 1), the selection circuit 230 turns off the transfer gate 234*a* and thus does not select the drive signal COMA, because the selection signal Sa is at the low level during the duration T1, and turns on the transfer gate 234*a* and thus selects the drive signal COMA, because the selection signal Sa is at the high level during the duration T2. Furthermore, because the selection signal Sb is at the low level during the durations T1 and T2, the selection circuit 230 turns off the transfer gate 234*b* and thus does not select the drive signal COMB. Furthermore, because the selection signal Sc is at the low level during the durations T1 and T2, the selection circuit 230 turns off the transfer gate 234*c*. As a result, the drive signal VOUT that corresponds to the "small-sized dot" that is illustrated in FIG. 7 is generated.

Furthermore, in the printing mode, when the printing data SI is (0, 0), because the selection signal Sa is at the low level during the durations T1 and T2, the selection circuit 230 turns off the transfer gate 234*a* and thus does not select the drive signal COMA. Furthermore, because the selection signal Sb is at the low level during the durations T1 and T2, the selection circuit 230 turns off the transfer gate 234*b* and thus does not select the drive signal COMB. Furthermore, because the selection signal Sc is at the low level during the durations T1 and T2, the selection circuit 230 turns off the transfer gate 234*c*. As a result, the drive signal VOUT that corresponds to the "non-recording" that is illustrated in FIG. 7 is generated.

As illustrated in FIG. 14, in the inspection mode, when the printing data SI is (0, 0), because the selection signal Sa is at the low level during the durations TS1, TS2 and TS3, the selection circuit 230 turns off the transfer gate 234*b* and thus does not select the drive signal COMA. Furthermore, because the selection signal Sb is at the low level during the durations TS1, TS2 and TS3, the selection circuit 230 turns off the transfer gate 234*a* and thus does not select the drive signal COMB. Furthermore, because the selection signal Sc is at the low level during the durations TS1, TS2 and TS3, the selection circuit 230 turns off the transfer gate 234*c*. As a result, the drive signal VOUT that corresponds to the "non-inspection" that is illustrated in FIG. 8 is generated during the durations TS1, TS2, and TS3.

Furthermore the inspection mode, when the printing data SI is (1, 1), because the selection signal Sa is at the low level during the durations TS1, TS2 and TS3, the selection circuit 230 turns off the transfer gate 234*a* and thus does not select the drive signal COMA. Furthermore, the durations TS 230 turns on the transfer gate 234*b* and thus selects the drive signal COMB, because the selection signal Sb is at the high level during the durations TS1 and TS3, and turns off the transfer gate 234B and thus does not select the drive signal COMB, because the selection signal Sb is at the low level during the duration TS2. As a result, the drive signal VOUT that corresponds to the "inspection" that is illustrated in FIG. 8 is generated during the durations TS1 and TS3. Furthermore, the selection circuit 230 turns off the transfer gate 234*c* because the selection signal Sc is at the low level during the durations TS1 and TS3, and turns on the transfer gate 234*c* because the selection signal Sc is at the high level during the duration TS2. As a result, during the duration TS2, the inspection-target signal PO that takes a waveform which is based on the residual vibration that occurs in the discharging section 600 is output to the waveform shaping circuit 80 by way of the transfer gate 234*c*.

Figure 16:
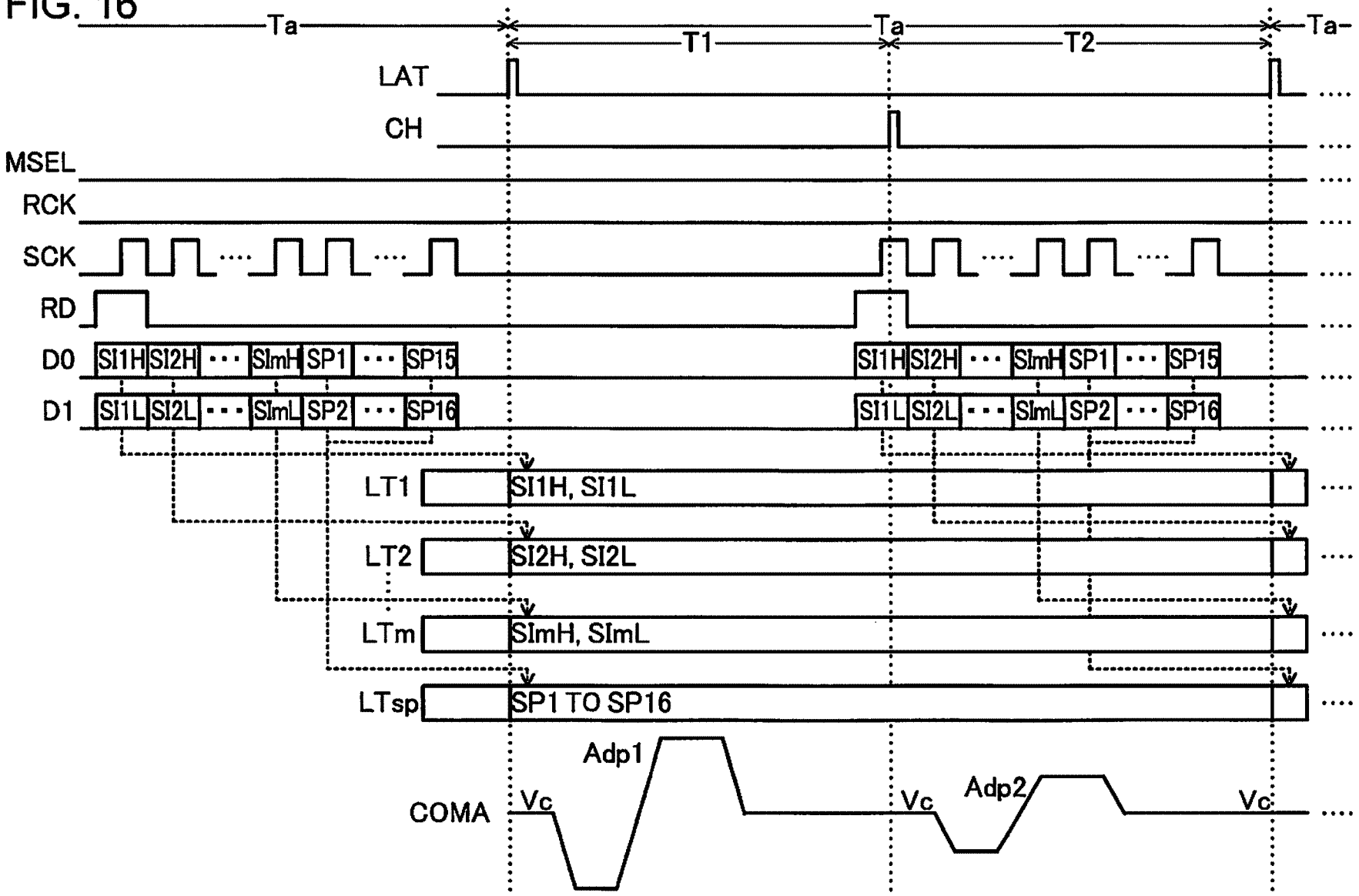
FIG. 16 is a diagram illustrating waveforms of various signals that are supplied to the data management section and update timings pieces of latch data, in the printing mode.

FIG. 16 is a diagram illustrating waveforms of various signals that are supplied to the data management section 222, and update timings for the pieces of latch data LT1 to LTm that are output from the m latch circuits 224, and for the latch data LTsp that is output from the latch circuit 225, in the printing mode. It is noted that in the present embodiment, the drive signal COMB is also supplied to the data management section 222 in the printing mode, but that the drive signal COMB is omitted from illustration in FIG. 16 because the drive signal COMB is not selected as the drive signal VOUT in the printing mode.

In an example in FIG. 16, in the printing mode, during each periodicity Ta, the data management section 222 is provided with the low-level operation mode selection signal MSEL, the low-level clock signal RCK, the clock signal SCK that includes (m+8) high pulses, the data retention selection signal RD that includes one high pulse, the bit data D0 that includes the pieces of printing data SI1H, SI2H, and so forth up to SImH and the pieces of program data SP1, SP3, and so forth up to SP15, and the bit data D1 that includes the pieces of printing data SI1L, SI2L, and so forth up to SImL and the pieces of program data SP2, SP4, and so forth up to SP16. Waveforms of, or timings for, these various signals and various pieces of data are as illustrated in FIG. 11. As illustrated in FIG. 11, during each periodicity Ta, the data management section 222 outputs the pieces of printing data SI1 to SIm and the pieces of program data SP1 to SP16, which are based on the pieces of bit data D0 and D1, at timings that are illustrated in FIG. 11.

At a timing when a next periodicity Ta starts, that is, when a next pulse of the latch signal LAT is on the rising phase, the pieces of printing data SI1 to SIm that are output from the data management section 222 are latched by the m latch circuits 224, respectively, and update on the pieces of latch data LT1 to LTm is performed. In the same manner, when a next pulse of the latch signal LAT is on the rising phase, the pieces of program data SP1 to SP16 that are output from the data management section 222 are latched by the latch circuit 225, and update on the latch data LTsp is performed. Then, during each periodicity Ta, based on the pieces of latch data LT1 to LTm and LTsp, the waveform of the drive signal COMA is selected and the drive signal VOUT that is to be supplied to each of the m discharging sections 600 is generated.

In this manner, in the example in FIG. 16, the printing data SI that is the first control data is the printing control data described above.

Figure 17:
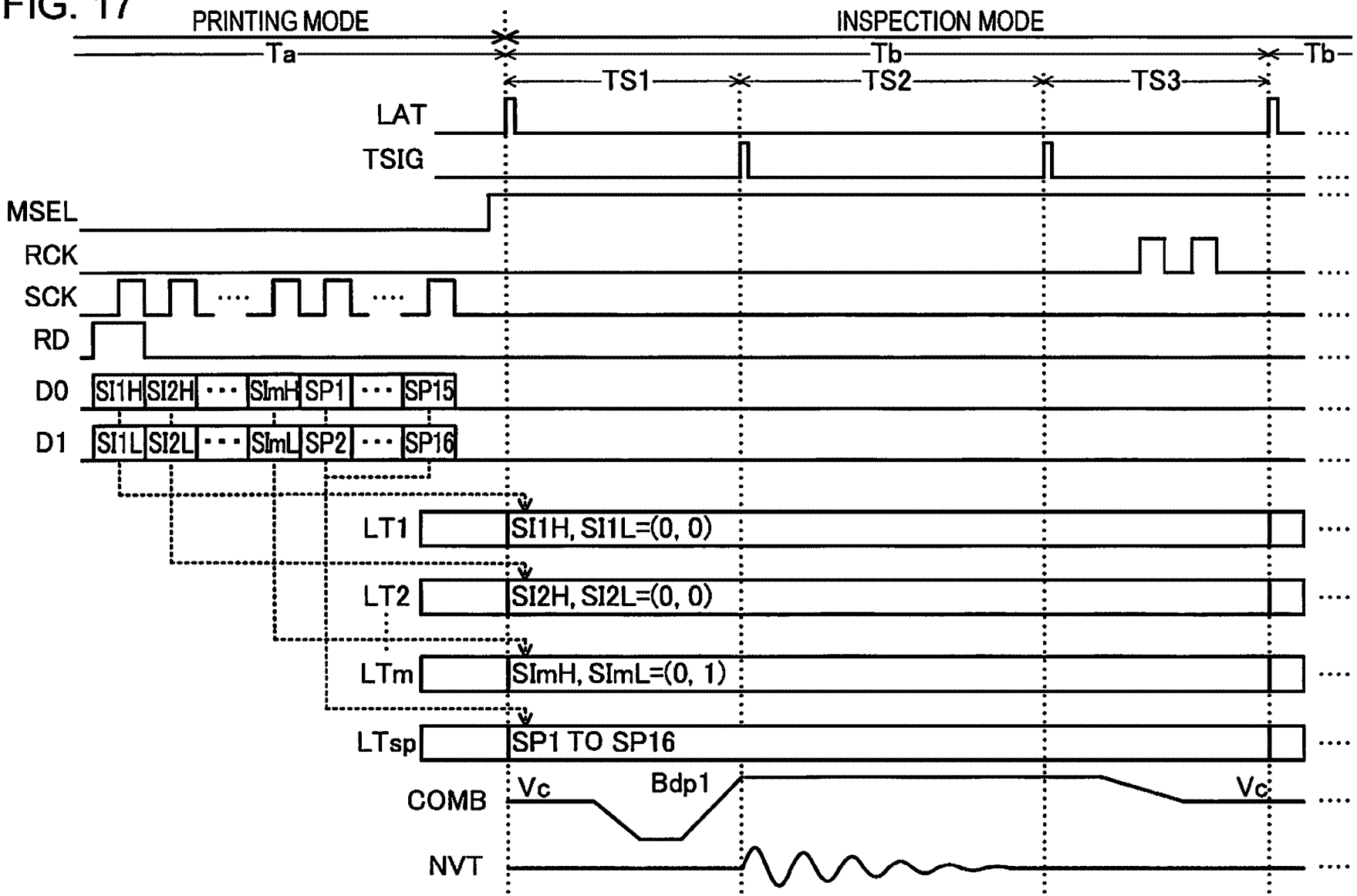
FIG. 17 is a diagram illustrating waveforms of various signals that are supplied to the data management section and update timings for pieces of latch data before and after switching from a printing mode to an inspection mode takes place.

FIG. 17 is a diagram illustrating waveforms of various signals that are supplied to the data management section 222 and update timings for the pieces of latch data LT1 to LTm that are output from the m latch circuits 224, and for the latch data LTsp that is output from the latch circuit 225, before and after switching from the printing mode to the inspection mode takes place. It is noted that in the present embodiment, the drive signal COMA is also supplied to the data management section 222 in the inspection mode, but that because the drive signal COMA is not selected as the drive signal VOUT in the inspection mode, the drive signal COMA is omitted from illustration in FIG. 17.

In an example in FIG. 17, in the printing mode, during each periodicity Ta immediately before the switching form the printing mode to the inspection takes place, the data management section 222 is provided with the low-level operation mode selection signal MSEL, the low-level clock signal RCK, the clock signal SCK that includes (m+8) high pulses, the data retention selection signal RD that includes one high pulse, the bit data D0 that includes the pieces of printing data SI1H, SI2H, and so forth up to SImH and the pieces of program data SP1, SP3, and so forth up to SP15, and the bit data D1 that includes the pieces of printing data SI1L, SI2L, and so forth up to SImL and the pieces of program data SP2, SP4, and so forth up to SP16. Waveforms of, or timings for, these various signals and various pieces of data are the same as illustrated in FIG. 16, but among the pieces of printing data SI1H, SI2H, and so forth up to SImH, and SI1L, SI2L and so forth up to SImL, the printing data SImL is "1," and the other pieces of printing data are all "0." Then, the data management section 222 outputs the pieces of printing data SI1 to SIm and the pieces of program data SP1 to SP16, which are based on the pieces of bit data D0 and D1. The pieces of printing data SI1 to SI(m−1) are (0, 0), and the printing data SIm is (0, 1).

Thereafter, the operation mode selection signal MSEL changes from the low level to the high level, and switches from the printing mode to the inspection mode. At a timing when an initial periodicity Tb starts in the printing mode, that is, when a next pulse of the latch signal LAT is on the rising phase, the pieces of printing data SI1 to SIm that are output from the data management section 222 are latched by the m latch circuits 224, respectively, and the update on the pieces of latch data LT1 to LTm is performed. In the same manner, when a next pulse of the latch signal LAT is on the rising phase, the pieces of program data SP1 to SP16 that are output from the data management section 222 are latched by the latch circuit 225, and update on the latch data LTsp is performed. Among the post-update pieces of latch data LT1 to LTm, the latch data LMm that corresponds to the printing data SIm=(SImH, SImL) is (0, 1) and the other pieces of latch data are all (0, 0). As described above, in the inspection mode, two-bit data (0, 1) is inspection target discharging-section designation data. Because of this, the m-th discharging section 600 is an inspection target in the periodicity Tb and the other (m−1) discharging sections 600 are not inspection targets. Then, during the periodicity Tb, based on the pieces of latch data LT1 to LTm, the waveform of the drive signal COMB is selected and the drive signal VOUT that is to be supplied to each of the m discharging sections 600 is generated. Accordingly, during the durations TS1 and TS3, the drive signal COMB is supplied to the discharging section 600 that is an inspection target, and during the duration TS2, a residual vibration signal NVT, which is based on the inspection-target signal PO which is output from the discharging section 600, is supplied to the inspection circuit 90.

In this manner, in the example in FIG. 17, the printing data SI, which is the first control data that is supplied to the data management section 222 in the last periodicity Ta in the printing mode, is the inspection control data described above.

Furthermore, in the example in FIG. 17, during the periodicity TS3, the clock signal RCK that includes two high pulses is supplied to the data management section 222. With these two high pulses, the pieces of printing data SI1 to SI(m−2) and SIm, which are output from the data management section 222, is (0, 0) and the printing data SI(m−1) is (0, 1). Then, at a time when a next periodicity Tb starts, that is, when a next pulse of the latch signal LAT is on the rising phase, the update on the pieces of latch data LT1 to LTm are performed, and among, the post-update pieces of latch data LT1 to LTm, the latch LT(m−1) that corresponds to the printing data SI(m−1) is (0, 1), and the other pieces of latch data are all (0, 0). As a result, during the periodicity Tb, the (m−1)-th discharging section 600 is an inspection target. It is noted that the waveforms of, and the timings for, the various signals and the various pieces of data during each periodicity Tb in the inspection mode are as illustrated in FIG. 12.

6. Configuration of Inspection Circuit

Figure 18:
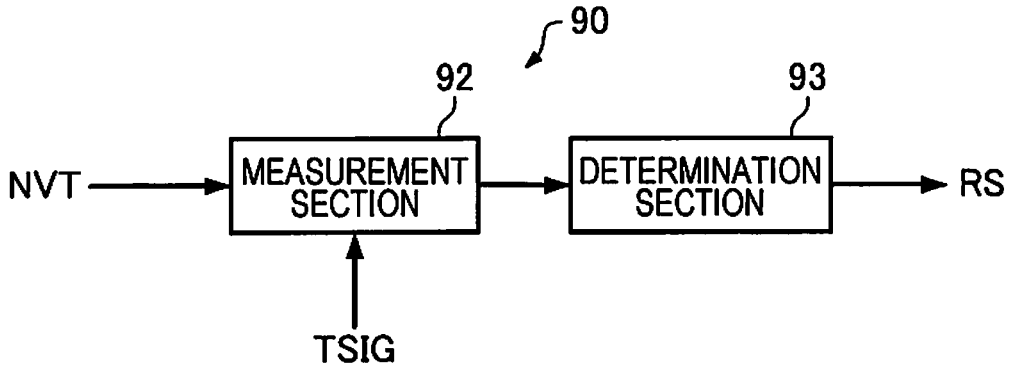
FIG. 18 is a diagram illustrating a configuration of an inspection circuit.

Next, configurations of the inspection circuits 90-1 to 90-4 will be described. It is hereinafter assumed that the inspection circuits 90-1 to 90-4 employ the same circuit configuration, and a configuration of one inspection circuit 90 is described. FIG. 18 is a diagram illustrating of the configuration of the inspection circuit 90. As indicated in FIG. 18, the inspection circuit 90 includes a measurement section 92 and a determination section 93.

The residual vibration signal NVT, which is output by the waveform shaping circuit 80, is input into the measurement section 92. During the periodicity TS2 that is designated with the inspection control signal TSIG, the measurement section 92 measures a phase, a periodicity, amplitude, and the like of the residual vibration signal NVT.

The determination section 93 determines the discharge state of the discharging section 600 that is an inspection target, based on the phase, the periodicity, the amplitude, and the like of the residual vibration signal NVT measured by the measurement section 92, and outputs a determination result signal RS indicating a result of the determination. The determination result signal RS may be a signal that indicates the presence or absence of the abnormality in discharging is present, and may be a signal including information that determines a cause of the abnormality in discharging. It is noted that the determination result signal RS is any one of the determination result signals RS1 to RS4.

Figure 19:
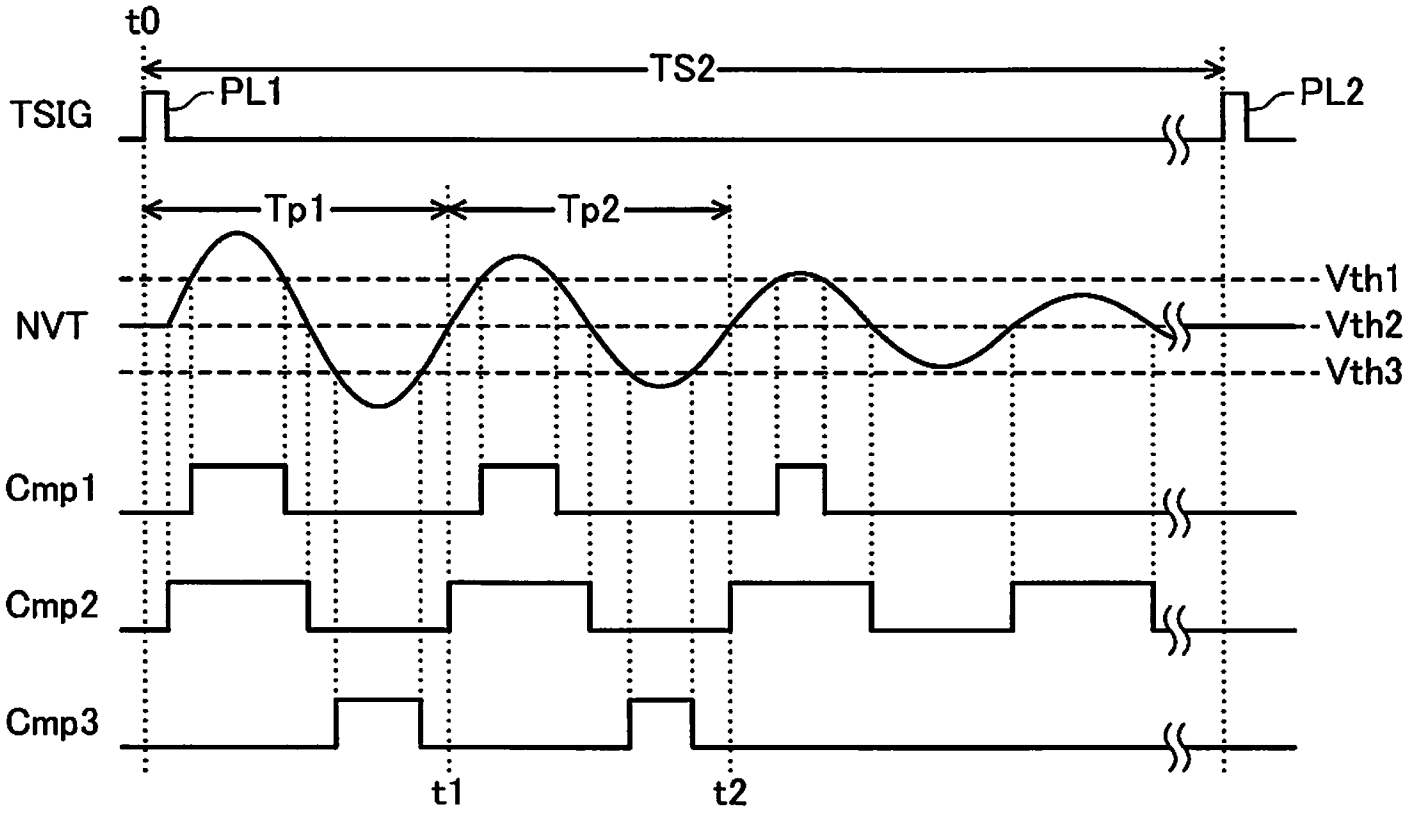
FIG. 19 is a diagram for describing operation of a measurement section.

FIG. 19 is a timing chart for describing operation of the measurement section 92. As illustrated in FIG. 19, when the duration TS2 starts and thus the residual vibration signal NVT starts to be supplied, the measurement section 92 make a comparison among the residual vibration signal NVT, threshold electric potential Vth2 that is electric potential which is at a level corresponding to the center of the amplitude of the residual vibration signal NVT, threshold electric potential Vth1 that is electric potential higher than the threshold electric potential Vth2, and threshold electric potential Vth3 that is electric potential higher than the threshold electric potential Vth2. Then, the measurement section 92 generates a comparison signal Cmp1 that is at a high level when the electric potential of the residual vibration signal NVT is at or above the electric potential Vth1, a comparison signal Cmp2 that is at the high level when the electric potential of the residual vibration signal NVT is at or above the electric potential Vth2, and a comparison signal Cmp3 that is at the high level when the electric potential of the residual vibration signal NVT is below the threshold electric potential Vth3.

The measurement section 92 measures a time Tp1 from starting time t0 during the duration TS2 to time t1 when the comparison signal Cmp2 is on the rising phase after falling to a low level for the first time. Furthermore, the measurement section 92 measures a time Tp2 from time t1 to time t2 when the comparison signal Cmp2 is on the rising phase after falling the low level for the second time.

When the amplitude of the residual vibration signal NVT is low, it is assumed that the abnormality in discharging, such as a situation where the cavity 631 is not filled with ink, occurs in the discharging section 600 that is an inspection target. Thus, the measurement section 92 sets an amplitude determination value Ap to "1," when the electric potential of the residual vibration signal NVT is at or above the threshold electric potential Vth1 during a duration from time t1 to time t2 and thus the comparison signal Cmp1 is at the high level and when the electric potential of the residual vibration signal NVT is below the threshold electric potential Vth3 during the duration from time t1 to time t2 and thus the comparison signal Cmp3 is at the high level. When such a case does not occur, the measurement section 92 sets the amplitude determination value Ap to "0."

Causes of a situation where, notwithstanding that the discharging section 600 performs an operation of discharging an ink droplet, the ink droplet is not normally discharged through the nozzle 651, that is, causes of occurrence of the abnormality in discharging, are given as follows: (1) mixing an air bubble into the cavity 631, (2) thickening of ink within the cavity 631 due to dried ink within the cavity 631, (3) adhering a foreign substance such as paper power to the vicinity of an orifice of the nozzle 651, and others.

First, when the air bubble is mixed into the cavity 631, it is considered that a total weight of ink that fills the cavity 631 is reduced and that inertance is decreased. Furthermore, when the air bubble is attached to the vicinity of the nozzle 651, it is considered that a state is reached where the more a diameter of the air bubble is increased, the more a diameter of the nozzle 651 is increased, and thus that acoustic resistance is decreased. For that reason, a frequency of the residual vibration is higher when the abnormality in discharging occurs due to the mixing of the air bubble into the cavity 631 than when the discharge state is normal. For that reason, the time Tp2 is shorter than a prescribed threshold time Tth2. Furthermore, if more air bubbles are mixed, the time Tp1 becomes shorter than the prescribed threshold time Tth1.

Next, when ink in the vicinity of the nozzle 651 is dried and thus is thickened, a situation of the ink within the cavity 631 is as if the ink is trapped within the cavity 631. In such a case, it is considered that the acoustic resistance is increased. For that reason, the frequency of the residual vibration is lower when the ink in the vicinity of the nozzle 651 within the cavity 631 is thickened than when the discharge state is normal. For that reason, the time Tp2 becomes longer than the prescribed threshold time Tth4.

Next, when a foreign substance, such as paper power, is attached to the vicinity of the orifice of the nozzle 651, because ink oozes from within the cavity 631 through the foreign substance such as the paper power, it is considered that the inertance increases. Furthermore, it is considered that the acoustic resistance is increased due to a fiber of the paper power attached to the vicinity of the orifice of the nozzle 651. For that reason, the frequency of the residual vibration decreases more when the foreign substance such as the paper power is attached to the vicinity of the orifice of the nozzle 651 than when the discharge state is normal. For that reason, the time Tp2 is longer than the prescribed threshold time Tth3 and is equal to or shorter than the threshold time Tth4.

Then, when the abnormality in discharging due to the causes (1) to (3) described above does not occur, that is, when the time Tp2 is equal to or longer than the threshold time Tth2 and is equal to or shorter than the threshold time Tth3, it is determined that the discharge state of the discharging section 600 is normal.

As described above, based on the time Tp1 that corresponds to a phase of the residual vibration, the time Tp2 that corresponds to a periodicity of the residual vibration, and the amplitude determination value Ap of the residual vibration, the determination section 93 can determine the discharge state of the discharging section 600 that is an inspection target, for example, the presence or absence of the abnormality in discharging, the cause of the abnormality in discharging, or the like.

FIG. 20 is a diagram illustrating an example of a logic for the determination of the discharge state of the discharging section 600 by the determination section 93. In an example in FIG. 20, when the time Tp1 is shorter than the threshold time Tth1, regardless of the time Tp2 and the amplitude determination value Ap, the determination section 93 determines that the abnormality in discharging due to the air bubble occurs in the discharging section 600, and sets the determination result signal RS to "2."

Furthermore, when the time Tp1 is equal to or shorter than the threshold time Tth1, based on the time Tp2 and the amplitude determination value Ap, the determination section 93 determines the discharge state of the discharging section 600. Specifically, if the amplitude determination value Ap is "0," although the cause of the abnormality in discharging cannot be specified, the determination section 93 determines that some abnormality in discharging occurs such as the situation where the cavity 631 is not filled with ink, and sets the determination result signal RS to "5." Furthermore, if the amplitude determination value Ap is "1," based on the time Tp2, the determination section 93 performs the discharge state of the discharging section 600. That is, if the time Tp2 is shorter than the threshold time Tth2, the determination section 93 determines that the abnormality in discharging due to the air bubble occurs in the discharging section 600, and sets the determination result signal RS to "2." Furthermore, when the time Tp2 is equal to or longer than the threshold tome Tth2 and is equal to or shorter than the threshold time Tth3, the determination section 93 determines that the discharge state of the discharging section 600 is normal, and sets the determination result signal RS to "1." Furthermore, when the time Tp2 is longer than the threshold time Tth3 and is equal to or shorter than the threshold time Tth4, the determination section 93 determines that the abnormality in discharging due to the attached foreign substance occurs in the discharging section 600, and sets the determination result signal RS to "3." Furthermore, if the time Tp2 is longer than threshold time Tth4, the determination section 93 determines that the abnormality in discharging due to the thickening occurs in the discharging section 600, and sets the determination result signal RS to "4."

It is noted that the determination result signal RS which is generated by the determination section 93 carries information having five values ranging from "1" to "5" in the example in FIG. 20, but may carry, for example, information having two values. Furthermore, the determination section 93 may use only one or two of the time Tp1, the time Tp2, and, the amplitude determination value Ap for generation of the determination result signal RS.

7. Operational Effects

As described above, in the present embodiment, the data management section 222 has the first transfer mode in which the 2m-bit printing data SI is parallelly transferred, as the first control data, to the first data retention section 250 that includes 2m flop-flops. Particularly, in the present embodiment, the data management section 222 operations in the first transfer mode in the printing mode, sequentially selects each bit from the first data retention section 250, transfers each bit data of the 2m-bit printing data SI, as the printing control data that controls discharging of liquid from each of the m discharging sections 600, to each selected bit, and thus parallelly transfers the printing data SI to the first data retention section 250. Therefore, when the data management section 222 transfers the 2m-bit printing data SI to the first data retention section 250 in the first transfer mode, because data that is retained by each flip-flop changes at most only one time, through-current flows at most only 2m times through the 2m flop-flops. In contrast with this, in a scheme in the related art, when the 2m-bit printing data SI is serially transferred to a shift register that includes 2m flip-flops, because data that is retained by one flip-flop changes at most 2m times, the through-current flows at most 2m Ax 2*m* times through the 2m flip-flops. That is, according to the present embodiment, because a maximum value of the number of times that the through-current flows in the first data retention section 250 can be reduced to ½m of that in the scheme in the related art, current consumed for the transfer of the printing data SI can be reduced. For example, in a case where one nozzle column 650 includes 1000 nozzle 651, because m=2000, a maximum value of consumed current due to the through current is greatly reduced up to 1/4000 of that in the scheme in the related art.

Furthermore, in the present embodiment, in the first transfer mode, the data management section 222 parallelly transfers the 16-bit program data SP, as the second control data, to the second data retention section 260 that includes 16 flip-flops. Particularly, in the present embodiment, the data management section 222 operates in the first transfer mode in the printing mode, sequentially selects each bit from the second data retention section 260, transfers each bit data of the 16-bit program data SP to each selected bits, and thus parallelly transfers the program data SP to the second data retention section 260. Therefore, when the data management section 222 transfers the 16-bit program data SP to the second data retention section 260 in the first transfer mode, because the data that is retained by each flip-flop changes at most only one time, the through-current flows at most only 16 times through the 16 flop-flops. In contrast with this, in the scheme in the related art, when the 16-bit program data SP is transferred to a shift register that includes 16 flip-flops, because the data that is retained by one flip-flop changes at most 16 times, the through-current flows at most 16 ^×16 times through the 16 flip-flops. That is, according to the present embodiment, because a maximum value of the number of times that the through-current flows in the second data retention section 260 can be reduced to 1/16 of that in the scheme in the related art, current consumed for the transfer of the program data SP can be reduced.

Furthermore, in the present embodiment, the data management section 222 has the second transfer mode in which the first data retention section 250 having 2m flip-flop is caused to operate as a shift register that serially transfers two-bit inspection target discharging-section designation data which designates the discharging section 600 that is to be inspected, among the m discharging sections 600. Particularly, in the present embodiment, the data management section 222 operates in the second transfer mode in the inspection mode, and can only shift the first data retention section 250 by two bits and thus change designation of the discharging section 600 that is an inspection target. That is, the time it takes to transfer the 2m-bit printing data SI, as the inspection control data that controls whether or not each of the 2m discharging sections 600 is an inspection target, to the first data retention section 250, is a time that is equivalent to two periodicities of the clock signal RCK. In contrast with this, in the scheme in the related art, because 2m-bit inspection control data is serially transferred to a register that includes 2m pieces of flip-flops, in order to change the designation of the discharging section 600 that is an inspection target, the first data retention section 250 needs to be shifted by 2*m* bits. That is, in the present embodiment, in order to inspect each discharging section 600, for the first data retention section 250, the data management section 222 may transfer inspection discharging-section designation data of which the number of bits is 1/m of the number of bits of the inspection control data. Because of this, the number of bits by which the first data retention section 250 is shifted can be reduced 1/m of that in the scheme in the related art. Therefore, according to the present embodiment, in the inspection mode, during the periodicity Tb that is equivalent to the time taken for the inspection of the discharging section 600, for the time taken for the transfer of the inspection control data, a bottleneck does not occur, and the periodicity Tb can be shortened. Because of this, the time taken for the inspection the m discharging section 600 can be shortened. For example, when one nozzle column 650 includes 1000 nozzle 651, m=2000. Because of this, the time taken for the transfer of the inspection control data is greatly shortened up to 1/4000 of that in the scheme in the related art. According to the present embodiment, the time taken for the inspection of the m discharging sections 600 is shortened, and thus, although the number of the nozzles increased, it is possible that the inspection of all the discharging sections 600 is performed. Because of this, the reliable of the printing is improved.

Furthermore, in the present embodiment, in the second transfer mode, the data management section 222 retains the program data SP in the second data retention section 260. That is, in the second transfer mode, the program data SP that is retained in the second data retention section 260 is not changed. Particularly, in the present embodiment, the data management section 222 operates in the second transfer mode in the inspection mode, and the program data SP that is retained in the second data retention section 260 is not changed. Because of this, the program data SP does not need to be transferred to the second data retention section immediately before switching from the second transfer mode to the first transfer mode takes place.

8. Modification Examples

In the embodiment described above, the inspection circuit 90 is provided on the control substrate 100, but at least one portion of the inspection circuit 90 may be provided on the head substrate 20. For example, the measurement section 92 may be provided on the head substrate 20.

Furthermore, in the embodiment described above, the determination section 93 of the inspection circuit 90 makes a determination of the discharge state of the discharging section 600 that is an inspection target, but based on the residual vibration signal NVT, the control section 111 may make the determination of the discharge state thereof.

Furthermore, in the embodiment described above, ink is described as not being discharged although the discharging section 600 that is an inspection target is driven with the drive signal COMB, but vibration of the drive signal COMB may be increased, thereby discharging ink from the discharging section 600. Because the more the amplitude of the drive signal COMB is increased, the more the amplitude of the residual vibration is increased, the precision of the determination is improved. In this case, for example, processing that detects the residual vibration is performed in the inspection mode before starting the printing processing or after ending the printing processing.

Furthermore, in the embodiment described above, the control substrate 100 and the head substrate 20 of the print head 21 are connected through one cable 190, but may be connected through multiple cables. Furthermore, various signals may be transmitted wirelessly from the control substrate 100 to the head substrate 20. That is, the control substrate 100 and the head substrate 20 may not be connected through the cable 190.

Furthermore, in the embodiment described above, the drive circuit 50 is provided on the control substrate 100, but may be provided on the head substrate 20.

Furthermore, in the embodiment described above, one or several portions of, or all portions of, the waveform of the drive signal COMA are selected and the drive signals VOUT that correspond to the "large-sized dot." the "middle-sized dot," the "small-sized," and the "non-recording," respectively, are generated, and one portion of the drive signal COMB is selected and thus the drive signal VOUT that corresponds to the "inspection" is generated. However, a method of generating the drive signal that is to be applied to each piezoelectric element 60 is not limited to this, and various methods are applicable. For example, by combining waveforms of multiple drive signals, drive signals that correspond to the "large-sized dot," the "middle-sized dot," the "small-sized," the "non-recording," and the "inspection," respectively, may be generated.

Furthermore, in the embodiment described above, in order to prescribe four gradations, the printing data for each discharging section 600 is two bits long, but the number of bits of the printing data may be 1 or be equal to or greater than 3 according to the number of necessary gradations.

Furthermore, in the embodiment described above, when the waveform of the drive signal COMA is changed, and so on, the control section 111 also changes the program data SP that is to be transmitted to the data management section 222, and thus a rule for selecting a drive waveform of the drive signal COMA is changed and a desired drive signal VOUT is generated. However, when the waveform of the drive signal COMA is not changed, the program data SP may not be transmitted. That is, the data management section 222 may not include the second data retention section 260.

Furthermore, in the embodiment described above, as an example of the liquid discharging apparatus 1, the ink jet printer that is of a serial scanner type or of a serial printer type, in which a print head moves and performs printing on a printing medium, is given, but it is also possible that the present disclosure finds application in an ink jet printer that is of a line head type, in which the print head performs the printing on the printing medium without moving.

Furthermore, in the embodiment described above, the control section 111 transmits the two-bit data signal DT, and in the first transfer mode, the data management section 222 parallelly transfers the two-bit printing data for each of the discharging section 600 each time the pulse of the clock signal SCK is on the rising phase. However, the number of bits of the data signal DT or the number of bits for the parallel transfer in the data management section 222 is not limited to 2. For example, with N as an arbitrary positive integer, the control section 111 transmits the 2N-bit data signal DT that includes N sets of pieces of two-bit printing data, and in the first transfer mode, the data management section 222 may parallelly transfer 2N-bit printing data that is included in the data signal DT, to the first data retention section 250, when the pulse of the clock signal SCK is on the rising phase. When this is done, if a periodicity of the clock signal SCK is the same as in the embodiment described above, because the total time taken for the transfer of the pieces of 2m-bit printing data SI is 1/N, although the number m of the discharging sections 600 is great, it is possible that the data management section 222 completes the parallel transfer of the pieces of 2m-bit printing data SI within the periodicity Ta. Alternatively, if the control section 111 transmits the 2N-bit data signal DT and the total time taken for the transfer of the pieces of 2m-bit printing data SI in the data management section 222 is the same as in the embodiment described above, because the periodicity of the clock signal SCK is N times, the setup time taken for the data transfer for each flip-flop that is included in the first data retention section 250 can be sufficiently secured. Therefore, a concern that a malfunction will occur in the printing mode is reduced.

Furthermore, in the embodiment described above, in the inspection mode, the data signal DT including the low-level bit data D1 is transmitted from the control section 111 to the data management section 222, and the low-level data D1 ins input into the flip-flop SIL-m, but low-level data that is input into the flip-flop SIL-m may not be transmitted to the control section 111. For example, the data management section 222 may include a selector that selects and outputs the bit data D1 when the operation mode selection signal MSEL is at the low level, and that selects and outputs low-level data when the operation mode selection signal MSEL is at the high level, and an output signs of the selector may be input into the flip-flop SIL-m.

Furthermore, in the embodiment described above, from the control section 111 to the data management section 222, the pieces of m-bit printing data are transmitted, as the pieces of bit data D0, in this order: SI1H to SImH, and the pieces of m-bit printing data are transmitted, as the pieces of bit data D1, in this order: SI1L to SImL, but the order in which the pieces of printing data are transmitted from the control section 111 to the data management section 222 is not limited to this. For example, from the control section 111 to the data management section 222, the pieces of m-bit printing data may be transmitted, as the pieces of bit data D0, in this order: SImH to SI1H, and the pieces of m-bit printing data may be transmitted, as the pieces of bit data D1, in this order: SImL to SI1L.

Furthermore, in the embodiment described above, in the second transfer mode, the first data retention section 250 is a shift register that results from connecting the flip-flops serially at an initial stage in this order: SIL-m, SIH-m, . . . , SIL-2, SIH-2, SIL-1, SIH-1, and two-bit data (0, 1) that is inspection target discharging-section designation data is shifted with two high pulses of the clock signal RCK, but the order in which the flip-flops that make up the shift register are connected is not limited to this. For example, in the second transfer mode, the first data retention section 250 may be a shift register that results from connecting the flip-flops serially at an initial stage in this order: SIL-m, SIL-(m−1), . . . , SIL-1, SIH-m, SIH-(m-1), . . . , SIH-1. If this is done, in the second transfer mode, two-bit data (0, 1) that is inspection target discharging-section designation data can be shifted with one high pulse of the clock signal RCK.

Furthermore, in the embodiment described above, in the inspection mode, the liquid discharging apparatus 1 inspects the presence or absence of a discharge defect of the discharging section 600 based on the residual vibration, but a detail of the inspection in the inspection mode is not limited to this. For example, according to an inspection instruction from a host computer, in the inspection mode, the control section 111 may supply the drive signal VOUT for discharging ink to the m discharging sections 600 and a nozzle check pattern may be formed on the printing medium P. If a user makes a visual observation of the nozzle check pattern on the printing medium P and can verify a discharge defect, the liquid discharging apparatus 1 may be caused to perform the maintenance processing, such as the cleaning processing or the wiping processing.

The present embodiment and the modification examples are described above, but the present disclosure is not limited to the present embodiment or the modification examples. It is possible that various modifications to the present disclosure are implemented within the scope that does not depart from the gist thereof. For example, it is also possible that each of the embodiments above and each of the modification examples describes above are combined.

The present disclosure includes substantially a configuration (for example, a configuration that has the same function, the same way, and the same result, or a configuration that has the same object and effect) that is the same as the configuration described in the embodiment. Furthermore, the present disclosure includes a configuration in which an insubstantial portion of the configuration that is described in the embodiment is replaced. Furthermore, the present disclosure includes a configuration that accomplishes the same operational effect, or a configuration that can achieve the same object, as the configuration described in the embodiment. Furthermore, the present disclosure includes a configuration that results from adding any technology known to the public to the configuration described in the embodiment.

What is claimed is:

1. A print head comprising:

multiple discharging sections, each of which discharges liquid based on a drive signal;

a data management section that includes a first data retention section and manages first control data that controls a state of each of the multiple discharging sections, and inspection target discharging-section designation data that designates the discharging section to be inspected, which is among the multiple discharging sections; and a drive waveform selection section that selects a waveform of the drive signal for each of the multiple discharging sections, based on data that is retained by the first data retention section, wherein the data management section has a first transfer mode in which the first control data is parallelly transferred to the first data retention section, and a second transfer mode in which the first data retention section is caused to operate as a shift register that serially transfers the inspection target discharging-section designation data.

2. The print head according to claim 1, wherein in the first transfer mode, the data management section sequentially selects each bit from the first data retention section and transfers each bit data of the first control data to each selected bit, and thus parallelly transfers the first control data to the first data retention section.

3. The print head according to claim 1, wherein a size of the inspection target discharging-section designation data is smaller than a size of the first control data.

4. The print head according to claim 1, wherein the data management section operates in the first transfer mode in a printing mode and operates in the second transfer mode in an inspection mode.

5. The print head according to claim 4, wherein the first control data is printing control data that controls discharging of liquid from each of the multiple discharging sections in the printing mode, or inspection control data that controls whether or not each of the multiple discharging sections is an inspection target, in the inspection mode, the inspection control data has the inspection target discharging-section designation data, and the data management section parallelly transfers the inspection control data to the first data retention section in the first transfer mode and then transitions from the first transfer mode to the second transfer mode.

6. The print head according to claim 1, wherein the data management section includes a second data retention section and manages second control data that designates a rule in which the drive waveform selection section selects the waveform of the drive signal, parallelly transfers the second control data to the second data retention section in the first transfer mode, and retains the second control data in the second data retention section in the second transfer mode, and the drive waveform selection section selects the waveform of the drive signal based on the data that is retained by the first data retention section and data that is retained by the second data retention section.

7. A liquid discharging apparatus comprising:

a print head; and a control section that controls the print head, wherein the print head includes multiple discharging sections each of which discharges liquid based on a drive signal, a data management section that includes a first data retention section and manages first control data that controls a state of each of the multiple discharging sections, and inspection target discharging-section designation data that designates the discharging section to be inspected, which is among the multiple discharging sections, and a drive waveform selection section that selects a waveform of the drive signal for each of the multiple discharging sections, based on data that is retained by the first data retention section, the control section transmits the first control data to the data management section, and the data management section has a first transfer mode in which the first control data is parallelly transferred to the first data retention section, and a second transfer mode in which the first data retention section is caused to operate as a shift register that serially transfers the inspection target discharging-section designation data.

8. The liquid discharging apparatus according to claim 7, wherein in the first transfer mode, the data management section selects sequentially each bit from the first data retention section and transfers each bit data of the first control data to each selected bit, and thus parallelly transfers the first control data to the first data retention section.

9. The liquid discharging apparatus according to claim 7, wherein a size of the inspection target discharging-section designation data is smaller than a size of the first control data.

10. The liquid discharging apparatus according to claim 7, wherein the data management section operates in the first transfer mode in a printing mode and operates in the second transfer mode in an inspection mode.

11. The liquid discharging apparatus according to claim 10, wherein the first control data is printing control data that controls discharging of liquid from each of the multiple discharging sections in the printing mode, or an inspection control data that controls whether or not each of the multiple discharging sections is an inspection target in the inspection mode, the inspection control data has the inspection target discharging-section designation data, and the data management section parallelly transfers the inspection control data to the first data retention section in the first transfer mode and then transitions from the first transfer mode to the second transfer mode.

12. The liquid discharging apparatus according to claim 7, wherein the control section transmits second control data that designates a rule in which the drive waveform selection section selects the waveform of the drive signal, to the data management section, the data management section includes a second data retention section, manages the second control data, parallelly transfers the second control data to the second data retention section in the first transfer mode, and retains the second control data in the second data retention section in the second transfer mode, and the drive waveform selection section selects the waveform of the drive signal based on the data that is retained by the first data retention section and data that is retained by the second data retention section.

* * * * *